US012797930B2

(12) United States Patent
Takagi et al.

(10) Patent No.: US 12,797,930 B2
(45) Date of Patent: Nov. 17, 2026

(54) CONTROL DEVICE FOR STEEL PLATE TEMPERATURE

(71) Applicant: TMEIC CORPORATION, Tokyo (JP)

(72) Inventors: Sanga Takagi, Tokyo (JP); Toshihito Shimotani, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 163 days.

(21) Appl. No.: 18/730,355

(22) PCT Filed: Dec. 28, 2022

(86) PCT No.: PCT/JP2022/048464
§ 371 (c)(1),
(2) Date: Jul. 19, 2024

(87) PCT Pub. No.: WO2024/142347
PCT Pub. Date: Jul. 4, 2024

(65) Prior Publication Data
US 2025/0100035 A1 Mar. 27, 2025

(51) Int. Cl.
*B21B 37/74* (2006.01)
*B21B 37/76* (2006.01)
(Continued)

(52) U.S. Cl.
CPC ..... *B21B 37/74* (2013.01)

(58) Field of Classification Search
CPC ..... B21B 37/74; B21B 37/76; B21B 38/006; B21B 45/02; B21B 45/0218; B21C 47/00
See application file for complete search history.

(56) References Cited

U.S. PATENT DOCUMENTS 6,225,609 B1 * 5/2001 Imanari ..... C21D 9/573 219/486
2013/0030561 A1 * 1/2013 Imanari ..... B21B 37/76 700/153
2021/0245215 A1 * 8/2021 Weinzierl ..... B21B 37/74

FOREIGN PATENT DOCUMENTS

JP 2007-090425 A 4/2007
JP 2021-186838 A 12/2021

OTHER PUBLICATIONS

International Search Report and Written Opinion mailed on Mar. 20, 2023, received for PCT Application No. PCT/JP2022/048464, filed on Dec. 28, 2022, 11 pages including partial English Translation.

* cited by examiner

*Primary Examiner* — Mohammed S. Alawadi
(74) *Attorney, Agent, or Firm* — XSENSUS LLP

(57) ABSTRACT

A target value and a detailed prediction value of the first control index ($T_1^{CTref}$, $T_1^{CTprd}$) are used to calculate an FF water injection amount. Target values of first and second control indexes ($T_1^{CTref}$, $T_2^{CTref}$) and measured values of first and second control indexes ($T_1^{CTact}$, $T_2^{CTact}$) are used to calculate an FB water injection amount. Coolant injection amounts in an FF bank group ($B_1$ to $B_j$) is controlled based on respective positions of segments constituting the steel plate, an initial water injection amount, and the FF water injection amount. Coolant injection amounts in an FB bank group ($B_{j+1}$ to $B_N$) is controlled based on the respective positions of the segments, the initial water injection amount, and the FB water injection amount.

10 Claims, 13 Drawing Sheets

(51) Int. Cl.

| | |
|---|---|
| ***B21B 38/00*** | (2006.01) |
| ***B21B 45/02*** | (2006.01) |
| ***B21B 47/02*** | (2006.01) |

CONTROL DEVICE FOR STEEL PLATE TEMPERATURE

CROSS-REFERENCE TO RELATED APPLICATION

This application is a national stage application, pursuant to 35 U.S.C. § 371, of International Patent Application No. PCT/JP2022/048464, filed Dec. 28, 2022, the entire contents of which are incorporated herein by reference.

FIELD

The present disclosure relates to an apparatus for controlling a temperature of a steel plate which is cooled by coolant water from a cooling bank group and then coiled by a coiler in a hot rolling line.

BACKGROUND

Important indexes of a steel plate in hot rolling include strength, ductility, toughness, and the like related to material of the steel plate. The material of the steel plate is determined by a cooling process on a runout table (hereinafter, also referred to as a "ROT") located on a downstream side of the hot rolling line. In the ROT, the temperature of the steel plate during the cooling process is controlled. This control may be referred to as a coiling temperature control, which is based on the temperature of the steel plate in a coiling process (i.e., a coiling temperature) that is performed after the cooling process.

In the cooling process on the ROT, there is a problem that a cooling effect on a top surface of the steel plate is different from that on a bottom surface of the steel plate due to an influence of gravity and differences in an equipment (e.g., differences in types and numbers of headers and nozzles, differences in flow rate, pressure, etc.). In addition, the thicker the steel plate is, the slower the soaking due to heat conduction inside the steel plate tends to be. Therefore, in a cooling process of a thick steel plate, a temperature difference is likely to occur between the top surface of the steel plate and the bottom surface of the steel plate. At this time, a warpage occurs in a width direction of the steel plate, which is called a camber. In particular, when the top surface temperature is lower than the bottom surface temperature, both ends in the width direction are warped upward. Then, the coolant water stays on the top surface of the steel plate to further lower the top surface temperature. As a result, the quality of the material of the steel plate is lowered, and the quality of the flatness is lowered. In addition, the coolant water staying on the top surface of the steel plate interferes with correct measurement of the temperature of the steel plate, resulting in a problem that an accuracy of temperature control using the measured temperature is lowered.

PLT1 proposes a technique for changing a supply manner of the coolant water from a plurality of cooling banks on the ROT in accordance with positions of the cooling bank group. Specifically, in PLT1, the ROT is divided into an upstream side area and a downstream side area, and among the plurality of cooling banks located in the upstream side area, cooling banks facing the bottom surface of the steel plate are controlled to be in a water cooling state whereas cooling banks facing the top surface of the steel plate are controlled to be in an air cooling state (i.e., a state in which the coolant water is not supplied). According to this control, the coolant water can be supplied only to the bottom surface of the steel plate in the upstream side area. Therefore, the temperature of the bottom surface of the steel plate passing through the upstream side area may be intentionally lowered to create a temperature difference between the top surface of the steel plate and the bottom surface of the steel plate. Therefore, it is possible to suppress the occurrence of a positive camber.

PLT2 proposes a control technique for a cooler comprising a cooling nozzle for supplying coolant water to a steel plate and two pyrometers (top and bottom surface pyrometers) arranged opposite downstream of the cooling nozzle. In this control, a difference between measured values of the two pyrometers (i.e., a temperature difference between the top surface of the steel plate and the bottom surface of the steel plate) is calculated. Based on a variation of the measured value difference, the temperature difference between the top surface and the bottom surface of an uncooled portion of the steel plate is predicted. Then, based on the predicted temperature difference, a ratio of a coolant injection amount from the cooling nozzle (i.e., a top surface side cooling nozzle) facing the top surface of the steel plate and a coolant injection amount from the cooling nozzle (i.e., a bottom surface side cooling nozzle) facing the bottom surface of the steel plate is corrected.

CITATION LIST

Patent Literature

[PLT1] JP2021-186838A
[PLT2] JP2007-090425A

SUMMARY

Technical Problem

However, in the control method described in PLT1, the temperature difference between the top surface and the bottom surface for suppressing the generation of the positive camber generates a negative camber, and this negative camber may deteriorate quality on the flatness. In addition, controlling the cooling bank facing the top surface of the steel plate in the upstream side area to the air cooling state means that cooling speed of the steel plate in this area is limited. Therefore, it is difficult to form a material called step cooling for rapidly cooling the steel plate on the upstream side in the ROT. Furthermore, controlling the cooling bank facing the bottom surface of the steel plate in the upstream side area to the water cooling state means that only the bottom surface of the steel plate in this area is quenched. Therefore, there is a possibility that the material is not uniform between the top surface of the steel plate and the bottom surface of the steel plate.

The control method described in PLT2 does not take into account changes in the temperature of the steel plate on an entry side of a cooler and in conveying speed of the steel plate. Therefore, it is impossible to use a feedforward control function for correcting a change in a condition (e.g., the entry side temperature or the conveying speed) from a preset calculation at which respective positions of the steel plate are individually calculated. Under a condition where there is a discrepancy between the water cooling efficiency of the top and bottom surfaces, where a temperature difference between the top and bottom surfaces is an issue, modifying a ratio of coolant injection amounts changes mean values of the top and bottom surface temperatures, respectively. Therefore, while the temperature difference between top and bottom surfaces can be reduced, it is not possible to adjust the average value of the temperature of the steel plate within a proper range even though this average value is changing, which is the original purpose of the temperature control.

The present disclosure has been made to solve the above-described problem, and an object of the present disclosure is to provide a technique capable of improving quality related to material and flatness of a steel plate cooled by coolant water from cooling bank group and wound by a coiler.

Solution to Problem

A first aspect of the present disclosure is a device for controlling temperature of a steel plate cooled by coolant water from cooling bank group provided downstream of a rolling mill and wound by a coiler provided downstream of the cooling bank group, the device having the following features.

The device comprises a processor configured to execute various types of information processing.

The cooling bank group includes FF bank group indicating cooling bank group for feedforward control and FB bank group indicating cooling bank group for feedback control. The processor is configured to:

acquire rolling setup information including at least valve pattern information related to opening order of multiple cooling valves of the cooling bank group and target value information of a coiling temperature of the steel plate, measured value information of rolling mill delivery-side temperature indicating a temperature of the steel plate at a delivery side of the rolling mill, measured value information of coiler entry-side top surface temperature indicating a temperature of the steel plate at an entry side of the coiler, measured value information of coiler entry-side bottom surface temperature indicating a temperature of the steel plate at the entry side of the coiler, and conveying speed information of the steel plate;

calculate respective positions of segments constituting the steel plate based on the conveying speed;

calculate a brief predicted value of coiling top surface temperature indicating the coiling temperature at the top surface of the steel plate and a brief predicted value of coiling bottom surface temperature indicating the coiling temperature at the bottom surface of the steel plate based on the rolling setup information and a preset temperature model;

calculate target values of first and second control indexes related to the coiling temperature based on the target value of the coiling temperature;

calculate initial water injection amounts in the FF bank group and the FB bank group such that the target value of the first control index matches the brief predicted value of the first control index that is calculated based on the brief predicted values of the coiling top surface temperature and the coiling bottom surface temperature;

correct the valve pattern such that the target value of the second control index matches the brief predicted value of the second control index that is calculated based on brief predicted values of the coiling top surface temperature and the coiling bottom surface temperature match;

calculate a detailed prediction value of the coiling top surface temperature and a detailed prediction value of the coiling bottom surface temperature based on the measured value of the rolling mill delivery-side temperature, the conveying speed, the rolling setup information, the modified valve pattern, and the temperature model;

calculate an FF water injection amount indicating a coolant injection amount in the FF bank group such that the target value of the first control index matches the detailed prediction value of the first control index that is calculated based on detailed prediction values of the coiling top surface temperature and the coiling bottom surface temperature;

calculate an FB water injection amount indicating a coolant injection amount in the FB bank group based on the measured values of the coiler entry-side top surface temperature and the coiler entry-side bottom surface temperature, the conveying speed, the rolling setup information, and the modified valve pattern such that the target value of the first control index matches the measured value of the first control index that is calculated based on the measured values of the coiler entry-side top surface temperature and the coiler entry-side bottom surface temperature, and the target value of the second control index matches the measured value of the second control index that is calculated based on the measured values of the coiler entry-side top surface temperature and the coiler entry-side bottom surface temperature;

control a coolant injection amount in the FF bank group based on respective positions of the segments, the initial water injection amount, and the FF water injection amount; and control a coolant injection amount in the FB bank group based on respective positions of the segments, the initial water injection amount, and the FB water injection amount.

A second aspect of the present disclosure is a device for controlling temperature of a steel plate cooled by coolant water from first and second cooling bank groups provided downstream of a rolling mill and wound by a coiler provided downstream of the first and second cooling bank groups, the device having the following features.

The device includes a processor configured to execute various types of information processing.

The first cooling bank group includes a first FF bank group indicating cooling bank group for feedforward control and a first FB bank group indicating cooling bank group for feedback control.

The second cooling bank group includes a second FF bank group indicating the cooling bank group for feedforward control and a second FB bank group indicating the cooling bank group for feedback control.

The first FB bank group is provided downstream of the first FF bank group, and the second FF bank group is provided downstream of the first FB bank group. The second FB bank group is provided downstream of the second FF bank group.

The processor is configured to:

acquire rolling setup information including at least information of valve patterns related to opening orders of multiple cooling valves included in the first and second cooling bank groups, information of target values of coiling temperatures of the steel plate, and information of target values of intermediate temperatures indicating temperatures of the steel plate at intermediate positions of the first FB bank group and the second FF bank group; information of measured values of rolling mill delivery-side temperature indicating a temperature of the steel plate at a delivery side of the rolling mill, information of measured values of coiler entry-side top surface temperature indicating a temperature of the top surface of the steel plate at an entry side of the coiler; information of measured values of middle top surface temperature indicating a temperature of the top surface of the steel plate at the intermediate position, information of measured values of middle bottom surface temperature indicating a temperature of the bottom surface of the steel plate at the intermediate position, and information of conveying speed of the steel plate;

calculate respective positions of segments constituting the steel plate based on the conveying speed;

calculate a brief predicted value of a middle top surface temperature indicating the intermediate temperature at the top surface of the steel plate and a brief predicted value of a middle bottom surface temperature indicating the intermediate temperature at the bottom surface of the steel plate based on the rolling setup information and a preset first temperature model;

calculate an intermediate target value based on the target value of the intermediate temperature, intermediate target values indicating target values of first and second control indexes related to the intermediate temperature;

calculate a first initial water injection amount in the first cooling bank group such that the middle target value of the first control index is equal to the brief predicted value of the first control index that is calculated based on the brief predicted values of the middle top surface temperature and the middle bottom surface temperature;

correct the valve pattern for the first cooling bank group such that the intermediate target value of the second control index matches the brief predicted value of the second control index that is calculated based on the brief predicted values of the middle top surface temperature and the middle bottom surface temperature;

calculate a detailed prediction value of the middle top surface temperature and a detailed prediction value of the middle bottom surface temperature based on the measured value of the rolling mill delivery-side temperature, the conveying speed, the rolling setup information, the modified valve pattern for the first cooling bank group, and the first temperature model;

calculate a first FF water injection amount indicating a coolant injection amount in the first FF bank group such that the intermediate target value of the first control index matches the detailed prediction value of the first control index that is calculated based on the detailed prediction values of the middle top surface temperature and the middle bottom surface temperature, and such that the intermediate target value of the second control index matches the detailed prediction value of the second control index related to the intermediate temperature that is calculated based on the detailed prediction values of the middle top surface temperature and the middle bottom surface temperature;

calculate a first FB water injection amount indicating a coolant injection amount in the first FB bank group based on the measured values of the middle top surface temperature and the middle bottom surface temperature, the conveying speed, the rolling setup information, and the modified valve pattern for the first cooling bank group such that the middle target value of the first control index matches the middle measured value of the first control index that is calculated based on the measured values of the middle top surface temperature and the middle bottom surface temperature, and such that the middle target value of the second control index matches the middle measured value of the second control index that is calculated based on the measured values of the middle top surface temperature and the middle bottom surface temperature;

calculate a brief predicted value of coiling top surface temperature indicating the coiling temperature at the top surface of the steel plate and a brief predicted value of coiling bottom surface temperature indicating the coiling temperature at the bottom surface of the steel plate based on the rolling setup information and a preset second temperature model;

calculate final target values indicating target values of first and second control indexes related to the coiling temperature based on the target value of the coiling temperature;

calculate a second initial water injection amount in the second cooling bank group such that the final target value of the first control index is equal to the brief predicted value of the first control index that is calculated based on the brief predicted values of the coiling top surface temperature and the coiling bottom surface temperature;

correct the valve pattern for the second cooling bank group such that the final target value of the second control index matches the brief predicted value of the second control index that is calculated based on the brief predicted values of the coiling top surface temperature and the coiling bottom surface temperature;

calculate a detailed prediction value of the coiling top surface temperature and a detailed prediction value of the coiling bottom surface temperature based on the measured values of the middle top surface temperature and the middle bottom surface temperature, the conveying speed, the rolling setup information, the modified valve pattern for the second cooling bank group, and the second temperature model;

calculate a second FF water injection amount indicating a coolant injection amount in the second FF bank group such that the final target value of the first control index matches the detailed prediction value of the first control index that is calculated based on the detailed prediction values of the coiling top surface temperature and the coiling bottom surface temperature and such that the final target value of the second control index matches the detailed prediction value of the second control index related to the coiling temperature that is calculated based on the detailed prediction values of the coiling top surface temperature and the coiling bottom surface temperature;

calculate a second FB water injection amount indicating a coolant injection amount in the second FB bank group based on the measured values of the coiling top surface temperature and the coiling bottom surface temperature, the conveying speed, the rolling setup information, and the modified valve pattern for the second cooling bank group, such that the final target value of the first control index matches the final measured value of the first control index that is calculated based on the measured values of the coiler entry-side top surface temperature and the coiler entry-side bottom temperature, and the final target value of the second control index matches the final measured value of the second control index that is calculated based on the measured values of the coiler entry-side top surface temperature and the coiler entry-side bottom surface temperature;

control a coolant injection amount in the first FF bank group based on respective positions of the segments, the first initial water injection amount and the first FF water injection amount;

control a coolant injection amount in the first initial bank group based on respective positions of the segments, the first FB water injection amount, and the first FB water injection amount;

control a coolant injection amount in the second FF bank group based on respective positions of the segments, the second initial water injection amount, and the second FF water injection amount; and control the coolant injection amount in the second initial bank group based on respective positions of the segments, the second FB water injection amount and the second FB water injection amount.

Effects of Invention

According to the first aspect, four types of values including the target value, the brief predicted value, the detailed prediction value, and the measured value are calculated for the first control index related to the coiling temperature of the steel plate. In addition, three types of values including the target value, the brief predicted value and the measured value are calculated for the second control index related to the coiling temperature of the steel plate.

The target value of the first control index and the brief predicted value of the first control index are used to calculate the initial water injection amount in the FF bank group and the FB bank group. Specifically, the initial water injection amount is calculated such that the target value of the first control index and the brief predicted value of the first control index match. The target value of the second control index and the brief predicted value of the second control index are used to modify the valve pattern related to the opening order of the FF bank group and the FB bank group. Specifically, the valve pattern is corrected such that the target value of the second control index and the brief predicted value of the second control index match.

The target value of the first control index and the detailed prediction value of the first control index are used to calculate the coolant injection amount in the FF bank group (the FF water injection amount). Specifically, the FF water injection amount is calculated such that the target value of the first control index and the detailed prediction value of the first control index match. The target values of the first and second control indexes and the measured values of the first and second control indexes are used to calculate a coolant injection amount in the FB bank group (the FB water injection amount). Specifically, the FB water injection amount is calculated such that the target value of the first control index and the measured value of the first control index match and the target value of the second control index and the measured value of the second control index match.

According to the first aspect, the coolant injection amount in the FF bank group is controlled based on respective positions of the segments constituting the steel plate, the initial water injection amount, and the FF water injection amount. Further, the coolant injection amount in the FB bank group is controlled based on the respective positions of the segments constituting the steel plate, the initial water injection amount, and the FB water injection amount. As described above, according to the first aspect, the coolant injection amount from the FF bank group and the FB bank group are controlled based on the target values of the first and second control indexes, the brief predicted values of the first and second control indexes, the detailed prediction value of the first control index, and the measured values of the first and second control indexes. Therefore, it is possible to improve the quality of the steel plate in terms of material and flatness.

According to the second aspect, in a cooling bank configuration including the first and second FF bank groups and the first and second FB bank groups, the same calculations as those executed in the first aspect on the initial water injection amount, the FF water injection amount, and the FB water injection amount are executed. Therefore, according to the second aspect, the coolant injection amounts from the first and second FF bank groups and the coolant injection amounts from the first and second FB bank groups are controlled based on the target values of the first and second control indexes, the brief predicted values of the first and second control indexes, the detailed prediction value of the first control index, and the measured values of the first and second control indexes. Therefore, it is possible to obtain the same effect as that of the first aspect.

DESCRIPTION OF EMBODIMENTS

Figure 1:
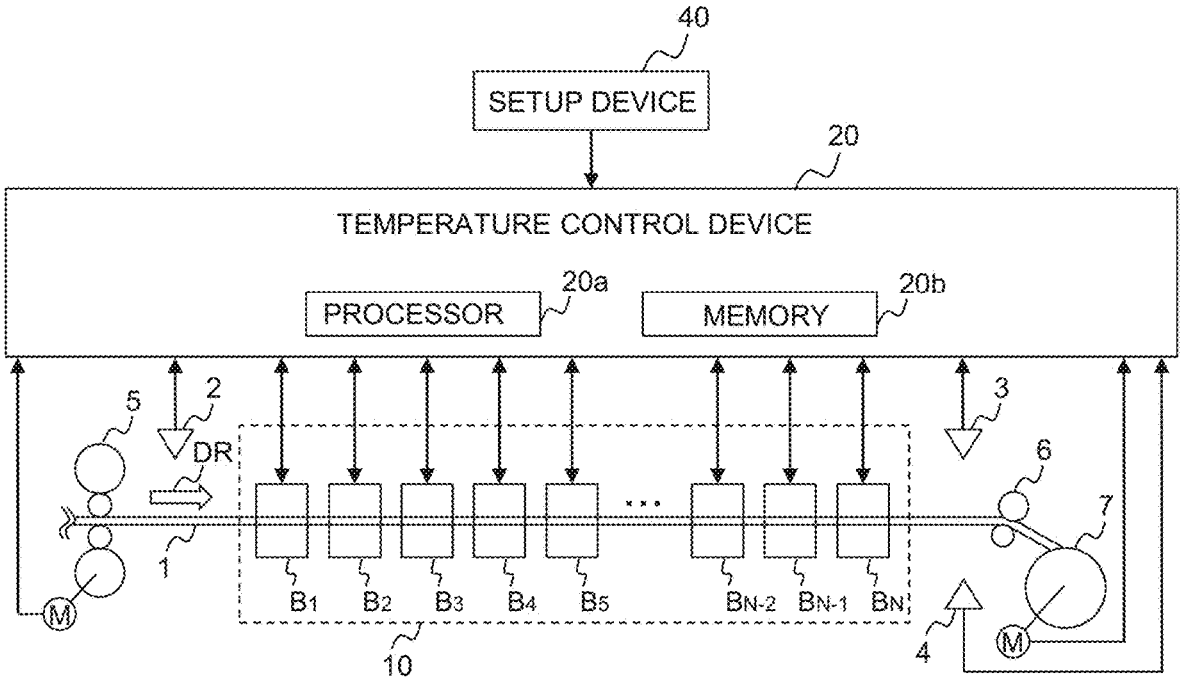
FIG. 1 is a diagram for explaining a configuration example of a hot rolling line to which a temperature control device according to a first embodiment is applied.

Hereinafter, a temperature control device for a steel plate according to embodiments of the present disclosure will be described in detail with reference to the drawings. In the drawings, common elements are denoted by the same reference numerals, and redundant description will be omitted.

1. First Embodiment

1-1. Configuration Example of Hot Rolling Line

FIG. 1 is a diagram for explaining a configuration example of a hot rolling line to which a temperature control device according to a first embodiment is applied. FIG. 1 illustrates a configuration from a finishing mill 5 to a coiler 7 in the hot rolling line. In the example shown in FIG. 1, a steel plate (a strip) 1 is transported in a direction DR. The steel plate 1 passing through a final stand of the finishing mill 5 passes through a cooling equipment 10 and a pinch roll 6 in a ROT and is wound by the coiler 7. Cooling banks $B_1$ to $B_N$ (N is a natural number of 2 or more) are provided in the cooling facility 10. Here, the steel plate 1 is managed in discrete units (segments) called "piece CPs" (see FIG. 5) obtained by dividing the steel plate 1 into M pieces in a longitudinal direction at a preset distance, and various measurements and controls are performed on each piece CP.

FIG. 1 also illustrates a finisher delivery-side pyrometer 2, a coiler entry-side top surface pyrometer 3, and a coiler entry-side bottom surface pyrometer 4. The finisher delivery-side pyrometer 2 measures a temperature of the steel plate 1 passing immediately below the finisher delivery-side pyrometer 2 (hereinafter also referred to as a "finishing delivery-side temperature $T^{FDT}$" or a "temperature $T^{FDT}$") and outputs a measured value $T^{FDTact}$ to a temperature control device 20. The coiler entry-side top surface pyrometer 3 measures a top surface temperature of the steel plate 1 passing immediately below the coiler entry-side top surface pyrometer 3 (hereinafter also referred to as a "coiling top surface temperature $T_{top}^{CT}$" or a "temperature $T_{top}^{CT}$"), and outputs a measured value $T_{top}^{CTact}$ to the temperature control device 20. The coiler entry-side bottom surface pyrometer 4 measures a bottom surface temperature of the steel plate 1 passing immediately above the coiler entry-side bottom surface pyrometer 4 (hereinafter also referred to as a "coiling bottom surface temperature $T_{bot}^{CT}$" or a "temperature $T_{bot}^{CT}$"), and outputs a measured value $T_{bot}^{CTact}$ to the temperature control device 20.

FIG. 1 further illustrates a setup device 40. The setup device 40 calculates information necessary for cooling process and coiling process (e.g., a thickness, a plate width, a target value $T_{top}^{CTref}$ of the temperature $T_{top}^{CT}$, a target value $T_{bot}^{CTref}$ of the temperature $T_{bot}^{CT}$ a valve pattern set in advance, and the like, hereinafter also referred to as a "rolling setup information") based on specifications of the steel plate 1 given from a host computer (not shown). The calculation of the rolling setup information is executed based on a calculation using a mathematical model, an index of a table value set in advance, an input from an operator, and the like. Calculation result of the rolling setup information is output to the temperature control device 20. Note that the target values $T_{top}^{CTref}$ and $T_{bot}^{CTref}$ may be target values of first and second control indexes to be described later.

The temperature control device 20 corresponds to a temperature control device of the present disclosure. The temperature control device 20 is a computer comprising at least one processor 20*a* and at least one memory 20*b*. The memory 20*b* stores various kinds of information acquired in the hot rolling line. Various kinds of information stored in the memory 20*b* include temperature information such as the measured value $T^{FDTact}$, the measured value $T_{top}^{CTact}$, and the measured value $T_{bot}^{CTact}$. The various types of information also include valve operation performance information acquired from the cooling banks $B_1$ to $B_N$, speed information such as the rolling speed of the steel plate 1 output from the final stand of the finishing mill 5, and the coiling speed of the steel plate 1 output from the coiler 7.

The various kinds of information stored in the memory 20*b* further include the rolling setup information, and calculation result information such as the conveying speed of the steel plate 1 calculated based on at least one of the rolling speed and the coiling speed. The processor 20*a* calculates open and close states of the plurality of valves included in the cooling banks $B_1$ to $B_N$ based on various kinds of information stored in the memory 20*b*, and individually operates these valves according to the calculation result.

1-2. Configuration Example of Cooling Bank

Figure 2:
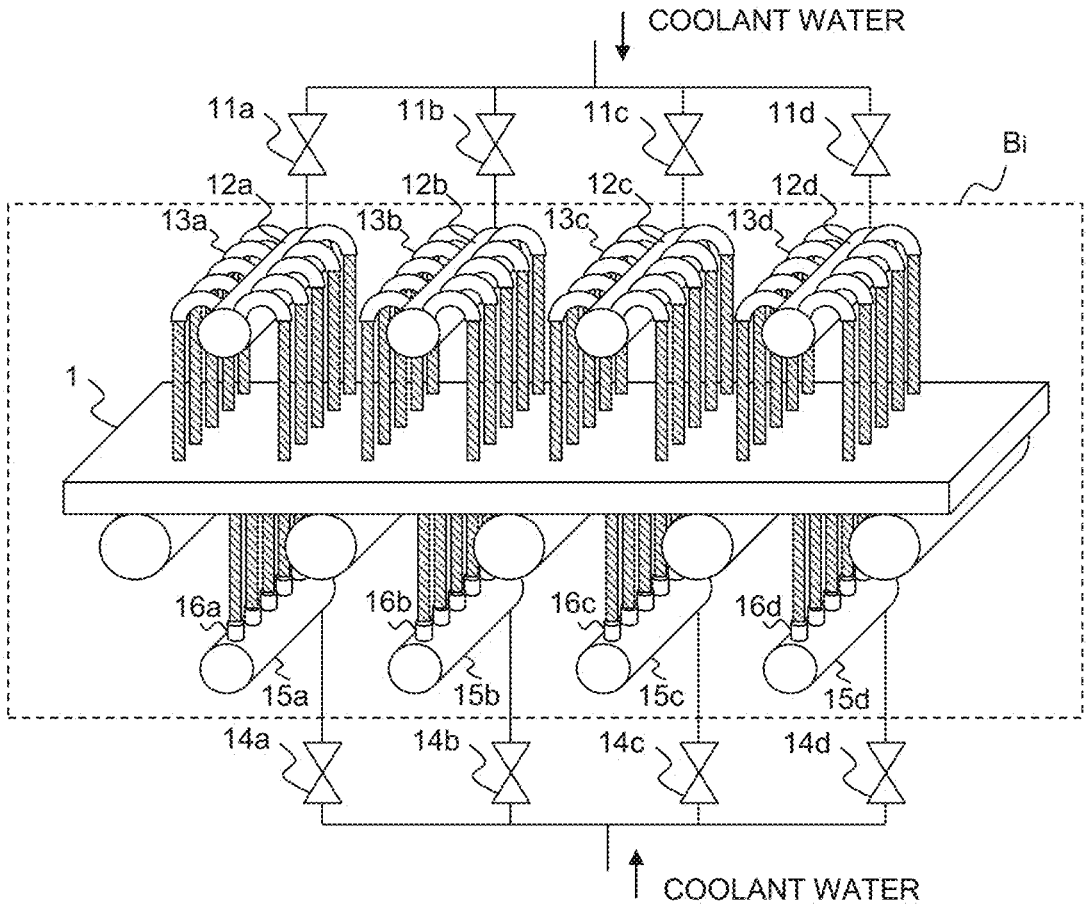
FIG. 2 is a diagram illustrating a configuration example of a cooling bank provided in a cooling facility.

FIG. 2 is a diagram for illustrating a configuration example of cooling banks provided in the cooling facility 10. A cooling bank $B_i$($1 \leq i \leq N$) shown in FIG. 2 is a pipe laminar type cooling bank. The cooling bank $B_i$ includes top surface cooling headers 12*a* to 12*d* and bottom surface cooling headers 15*a* to 15*d* arranged in a longitudinal direction of the cooling bank $B_i$. The top surface cooling headers 12*a* to 12*d* are provided in an upper space of the cooling facility 10. The bottom surface cooling headers 15*a* to 15*d* are provided in a lower space of the cooling facility 10. Note that total number of the top surface cooling headers 12*a* to 12*d* and that of the bottom surface cooling headers 15*a* to 15*d* are not particularly limited, and may be one or more, respectively.

The top surface cooling headers 12*a* to 12*d* are connected to top surface cooling valves 11*a* to 11*d*, respectively. The bottom surface cooling headers 15*a* to 15*d* are connected to bottom surface cooling valves 14*a* to 14*d*, respectively. The top surface cooling valves 11*a* to 11*d* and the bottom surface cooling valves 14*a* to 14*d* are examples of the valves included in the cooling bank $B_i$. Hereinafter, when the top surface cooling valves 11*a* to 11*d* are not particularly distinguished from each other, these are collectively referred to as a "top surface cooling valve 11", and when the bottom surface cooling valves 14*a* to 14*d* are not particularly distinguished from each other, these are collectively referred to as a "bottom surface cooling valve 14".

The open and close states of the top surface cooling valve 11 and the bottom surface cooling valve 14 are individually controlled based on an instruction from the temperature control device 20. When the top surface cooling valve 11*a* is opened, coolant water is sprayed from the multiple top surface cooling nozzles 12*a* provided in the top surface cooling header 13*a*. When the top surface cooling valves 11*b* to 11*d* are opened, coolant water is sprayed from the multiple top surface cooling nozzles 13*b* to 13*d*. When the bottom surface cooling valve 14*a* is opened, coolant water is sprayed from the multiple bottom surface cooling nozzles 15*a* provided in the bottom surface cooling header 16*a*. When the bottom surface cooling valves 14*b* to 14*d* are opened, coolant water is sprayed from the multiple bottom surface cooling nozzles 16*b* to 16*d*. The configuration of the pipe laminar type shown in FIG. 2 is an example, and any cooling bank having a configuration in which the coolant injection amount can be adjusted in the upper space and the lower space of the cooling facility 10 can be applied to the present disclosure.

Figure 3:
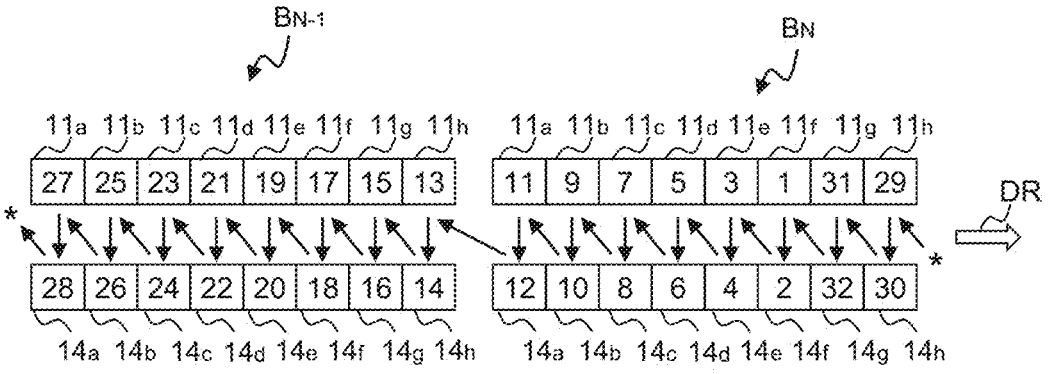
FIG. 3 is a diagram illustrating an example of a valve pattern.

The open and close states of the plurality of valves (i.e., the top surface cooling valve 11 and the bottom surface cooling valve 14) of the cooling banks $B_1$ to $B_N$ are determined based on a valve pattern (a valve priority) related to the opening order of these valves such that the coiling temperature (i.e., the temperatures $T_{top}^{CT}$ and $T_{bot}^{CT}$) of the steel plate 1 matches the target value (i.e., the target values $T_{top}^{CTref}$ and $T_{bot}^{CTref}$). FIG. 3 is a diagram for illustrating an example of the valve pattern. The valve pattern illustrated in FIG. 3 is an example of a setting valve pattern included in the rolling setup information (which refers to a valve pattern set in advance corresponding to the steel plate 1, the same applies hereinafter). In this example, all the valves of the cooling banks $B_N$ and $B_{N-1}$ are numbered from "1" to "32". These numbers represent the opening order.

Figure 4:
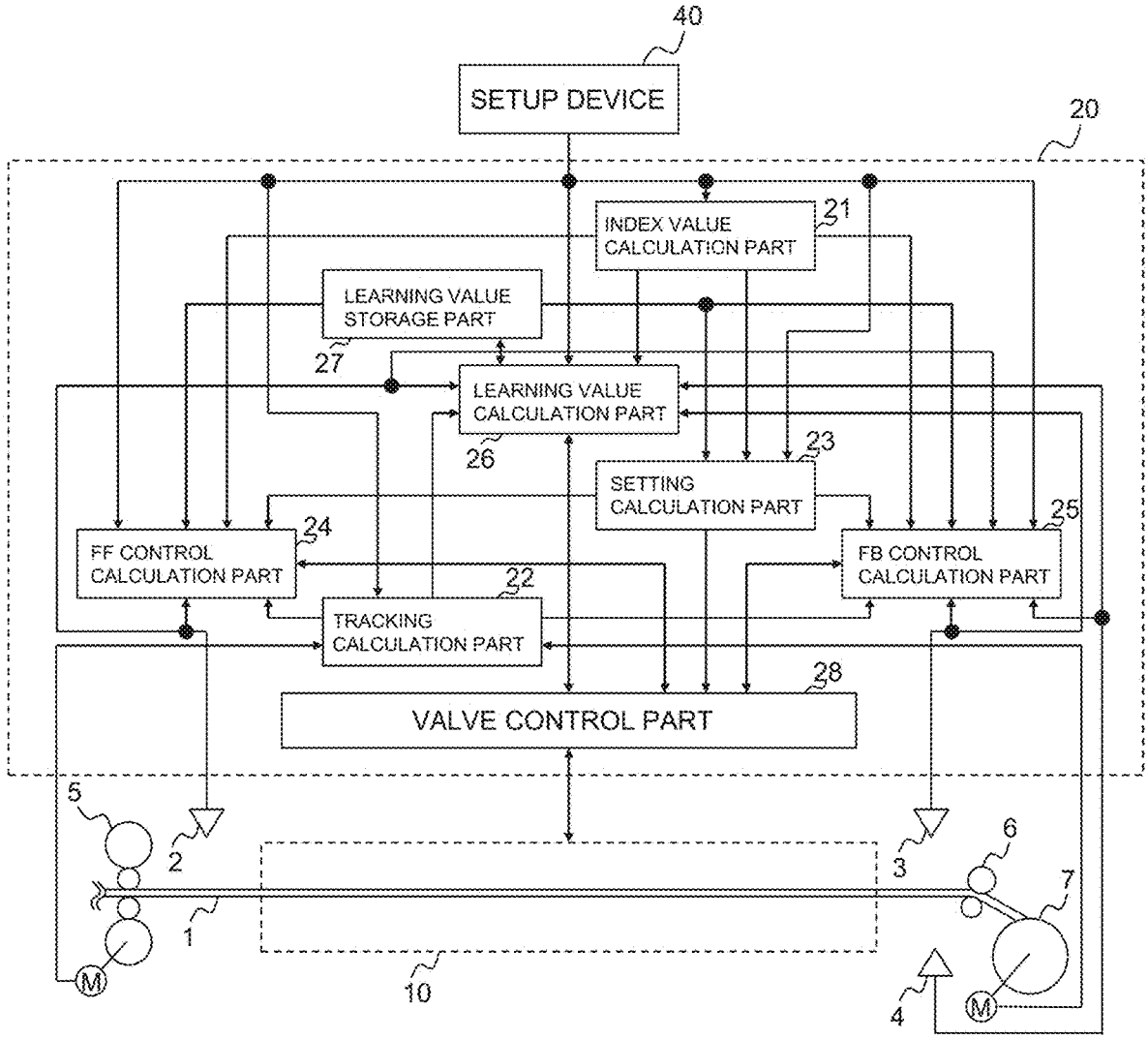
FIG. 4 is a diagram illustrating a functional configuration example of the temperature control device according to the first embodiment.

1-3. Functional Configuration Example of Temperature Control Device A functional configuration example of the temperature control device according to the first embodiment will be described with reference to FIG. 4. As shown in FIG. 4, the temperature control device 20 includes an index value calculation part 21, a tracking calculation part 22, a setting calculation part 23, an FF (feedforward) control calculation part 24, an FB (feedback) control calculation part 25, a learning value calculation part 26, a learning value storage part 27, and a valve control part 28. These functions are realized by, for example, the processor 20*a* illustrated in FIG. 1 executing a predetermined program stored in the memory 20*b*. Here, an outline of the function of the temperature control device 20 will be described, and details of processing executed by the temperature control device 20 will be described later.

The index value calculation part 21 calculates a target value $T_1^{CT}$ of a first control index $T_1^{CTref}$ and a target value $T_2^{CT}$ of a second control index $T_2^{CTref}$ by using the target values $T_{top}^{CTref}$ and $T_{bot}^{CTref}$ and a preset coefficient matrix. The target values $T_1^{CTref}$ and $T_2^{CTref}$ are output to the setting calculation part 23, the FF control calculation part 24, the FB control calculation part 25, and the learning value calculation part 26, respectively. When the target values $T_1^{CTref}$ and $T_2^{CTref}$ are directly given from the setup device 40, these target values may be output as they are.

The tracking calculation part 22 calculates respective positions of the piece CPs based on the conveying speed of the steel plate 1 in the ROT. The calculation result of respective positions of the piece CPs is output to the valve control part 28 for a timing management of valve operation. The calculation result is also output to the FF control calculation part 24 and the FB control calculation part 25 for the purpose of control calculation. As the conveying speed of the steel plate 1, rolling speed acquired from the final stand of the finishing mill 5, coiling speed acquired from the coiler 7, or an average value of the rolling speed and the coiling speed is used. The rolling speed is preferably corrected to the conveying speed of the delivery side of the finishing mill 5 by acquiring a forward slip of the final stand of the finishing mill 5 from the setup device 40. As the rolling speed, a value directly measured by a speedometer installed in a facility such as the cooling facility 10 may be used. In the following description, it is assumed that the average value of the rolling speed and the coiling speed is used as the conveying speed.

The setting calculation part 23 calculates a modified valve pattern (a modified set valve pattern, the same applies hereinafter) and an initial open and close state of the valve based on the setting valve pattern included in the rolling setup information and the target values $T_1^{CTref}$ and $T_2^{CTref}$. The term "initial" as used herein means a period before the FF control or the FB control is started. A calculation example of the modified valve pattern and the initial open and close state of the valve will be described later in the description of FIG. 6. The calculation results of the modified valve pattern and the initial open and close state of the valve are output to the FF control calculation part 24, the FB control calculation part 25 and the valve control part 28, respectively, for the purpose of control calculation.

Figure 5:
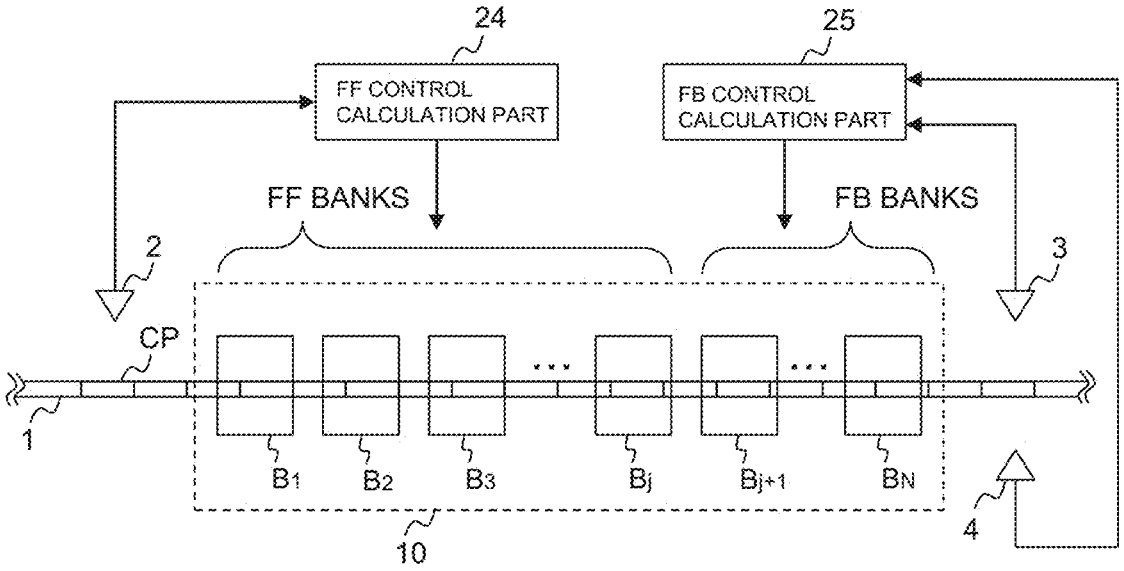
FIG. 5 is a diagram for explaining an FF control calculation part and an FB control calculation part.

The FF control calculation part 24 and the FB control calculation part 25 will be described with reference to FIG. 5. In the first embodiment, the cooling banks $B_1$ to $B_N$ include cooling banks $B_1$ to $B_j$ ($1 \leq j \leq N-1$) to be subjected to the FF control and cooling banks $B_{j+1}$ to $B_N$ to be subjected to the FB control. In the example shown in FIG. 5, the cooling banks $B_1$ to $B_j$ are located on the upstream side of the cooling facility 10, and the cooling banks $B_{j+1}$ to $B_N$ are located on the downstream side of the cooling facility 10. The cooling banks $B_1$ to $B_j$ and the cooling banks $B_{j+1}$ to $B_N$ are set based on, for example, the rolling setup information. Hereinafter, when the cooling banks $B_1$ to $B_j$ are not particularly distinguished from each other, they are collectively referred to as "FF banks", and when the cooling banks $B_{j+1}$ to $B_N$ are not particularly distinguished from each other, they are collectively referred to as "FB banks".

The FF control calculation part 24 calculates the open and close states of the plurality of valves included in the FF banks based on the rolling setup information, the conveying speed, the measured value $T^{FDTact}$, the modified valve pattern, and the temperature model such that the cooling process of a piece CP to be cooled (e.g., a piece CP located on the entry side of the cooling facility 10) is optimized. The operation result of the open and close state is output to the valve control part 28. The temperature model is expressed by, for example, the following Equation (1).

[Equation 1]

$$\begin{bmatrix} T_{top}^{CTprd} \\ T_{bot}^{CTprd} \end{bmatrix} = f\left(T_{top}^{FDT}, T_{bot}^{FDT}, X_1, X_2, \ldots, X_N, z_{top}^{CT}, z_{bot}^{CT}\right) \quad (1)$$

In Equation (1), $T_{top}^{CTprd}$ is a predicted value (a detailed prediction value) of the coiling top surface temperature $T_{top}^{CT}$, and $T_{bot}^{CTprd}$ is a predicted value (a detailed prediction value) of the coiling bottom surface temperature $T_{bot}^{CT}$. $X_1, X_2, \ldots, X_N$ are parameters such as the rolling setup information, the conveying speed, the valve open and close state, etc. $z_{top}^{CT}$ is a learning value related to the coiling top surface temperature $T_{top}^{CT}$, and $z_{bot}^{CT}$ is a learning value related to the coiling bottom surface temperature $T_{bot}^{CT}$.

As can be understood from the right-hand side of Equation (1), the function f is a multi-input multi-output function in which the temperatures $T_{top}^{FDT}$ and $T_{bot}^{FDT}$, various parameters such as the rolling setup information, and the learning value are input to one piece CP and predicted values $T_{top}^{CTprd}$ and $T_{bot}^{CTprd}$ are output. Note that in the first embodiment, the measured values $T_{top}^{FDTact}$ and $T_{bot}^{FDTact}$ are assumed to be equal to the measured value $T^{FDTact}$, and the measured value $T^{FDTact}$ is entered into Equation (1) as these values.

The FB control calculation part 25 calculates the open and close states of the plurality of valves included in the FB banks based on the rolling setup information, the conveying speed, the measured value $T^{FDTact}$, and the modified valve pattern so as to optimize the cooling process of a piece CP to be cooled (e.g., a piece CP located between the cooling bank $B_j$ and the cooling bank $B_{j+1}$). The operation result of the open and close state is output to the valve control part 28.

The learning value calculation part 26 calculates learning values (i.e., learning values $z_{top}^{CT}$ and $z_{bot}^{CT}$) for correcting errors between the predicted values (i.e., the predicted values $T_{top}^{CTprd}$ and $T_{bot}^{CTprd}$) that are calculated by using the temperature model and actual measured values (i.e., the measured values $T_{top}^{CTact}$ and $T_{bot}^{CTact}$). The learning value is updated, for example, after the steel plate 1 is cooled by the cooling facility 10. In this case, historical information of the predicted value and the measured value is temporarily stored in the memory 20*b* together with the rolling setup information of the steel plate 1, historical information of the conveying speed of the steel plate 1, and operation result information of the plurality of valves included in the FF banks and the FB banks during the cooling of the steel plate 1.

In another example, the learning values are updated during cooling of the steel plate 1 by the cooling facility 10. When the learning values are updated during the cooling of the steel plate 1, learning values for the same steel plate as the steel plate 1 are calculated based on the historical information of the predicted value and the measured value for the steel plate 1. In this case, the historical information of the predicted value and the measured value before the calculation of the learning values is temporarily stored in the memory 20*b* together with the rolling setup information of the steel plate 1, the historical information of the conveying speed of the steel plate 1 before the calculation of the learning values, and the operation result information of the plurality of valves included in the FF banks and the FB banks before the calculation of the learning values.

The learning value storage part 27 records the learning values calculated by the learning value calculation part 26 in a table divided based on the rolling setup information.

The valve control part 28 adjusts respective coolant injection amounts by opening and closing the plurality of valves (i.e., the top surface cooling valve 11 and the bottom surface cooling valve 14) included in the FF banks and the FB banks based on the information of respective positions of the piece CPs of the steel plate 1 conveyed on the ROT, the information of the conveying speed of the steel plate 1, and the information of the open and close state of the valve in each cooling process of the piece CPs.

1-4. First and Second Control Indexes

The calculations executed in the setting calculation part 23, the FF control calculation part 24, and the FB control calculation part 25 are performed using the target values $T_1^{CTref}$ and $T_2^{CTref}$. As described above, the calculation of the target values $T_2^{CTref}$ and $T_2^{CTref}$ is performed in the index value calculation part 21. The calculation of the target values $T_1^{CTref}$ and $T_2^{CTref}$ is performed according to the following Equations (2) to (4).

[Equation 2]

$$T_1^{CT} = a_1 \cdot T_{top}^{CT} + b_1 \cdot T_{bot}^{CT} \tag{2}$$

[Equation 3]

$$T_2^{CT} = a_2 \cdot T_{top}^{CT} + b_2 \cdot T_{bot}^{CT} \tag{3}$$

[Equation 4]

$$A = \begin{bmatrix} a_1 & b_1 \\ a_2 & b_2 \end{bmatrix} \tag{4}$$

In Equations (2) to (4), $a_1$, $b_1$, $a_2$, and $b_2$ are coefficients for distributing the coiling top surface temperature $T_{top}^{CT}$ and the coiling bottom surface temperature $T_{bot}^{CT}$. The coefficients $a_1$, $b_1$, $a_2$, and $b_2$ are set in advance. However, these coefficients are set such that the coefficient matrix A shown in the Equation (4) is regular. In the following description, a case in which the coefficients ($a_1$, $b_1$, $a_2$, $b_2$)=(1, 0, 1, −1), that is, a case in which the first control index $T_1^{CT}$ is the temperature $T_{top}^{CT}$ and the second control index $T_2^{CT}$ is the difference between the temperature $T_{top}^{CT}$ and the temperature $T_{bot}^{CT}$ will be described, but the combination of the coefficients ($a_1$, $b_1$, $a_2$, $b_2$) is not limited to this example. It should be noted that the first control index $T_2^{CT}$ is easier to control a variation over the entire length of the steel plate 1 than the second control index $T_1^{CT}$. Therefore, it is desirable to set the temperature $T_{top}^{CT}$ or mean value of the temperature $T_{top}^{CT}$ and the temperature $T_{bot}^{CT}$ as the first control index $T_1^{CT}$.

The index value calculation part 21 outputs the calculated target value $T_1^{CTref}$ and target value $T_2^{CTref}$ to the setting calculation part 23, the FF control calculation part 24, the FB control calculation part 25, and the learning value calculation part 26, respectively.

1-5. Processing Example by Temperature Control Device

The processing performed by the setting calculation part 23, the FF control calculation part 24, the FB control calculation part 25, the learning value calculation part 26, and the valve control part 28 will be described in detail. The processing by these functional units includes setting processing, control processing, and learn processing. The setting processing is executed before a first (a head end) piece CP of the steel plate 1 reaches the position of the finisher delivery-side pyrometer 2. The control processing is started after this first piece CP reaches the position of the finisher delivery-side pyrometer 2. The control processing is also terminated after a final (a tail end) piece CP of the steel plate 1 reaches the position of the coiler entry-side top surface pyrometer 3 (or the position of the coiler entry-side bottom surface pyrometer 4). The learn processing is started after the final piece CP reaches the position of the coiler entry-side top surface pyrometer 3 (or the position of the coiler entry-side bottom surface pyrometer 4). The learn processing may be started after the first piece CP reaches the position of the coiler entry-side top surface pyrometer 3 (or the position of the coiler entry-side bottom surface pyrometer 4).

At the start of setting processing, the setting calculation part 23 is supplied with the rolling setup information from the setup device 40. The rolling setup information includes the setting valve pattern and a setting conveying speed (a conveying speed preset corresponding to the steel plate 1). The setting calculation part 23 is supplied with the target values $T_1^{CTref}$ and $T_2^{CTref}$ from the index value calculation part 21. The setting calculation part 23 calculates the modified valve pattern such that the target value $T_2^{CTref}$ can be achieved regardless of the number of open valves (open state valves). The setting calculation part 23 also calculates an initial number of the open valves that can simultaneously achieve the target value $T_1^{CTref}$.

Figure 6:
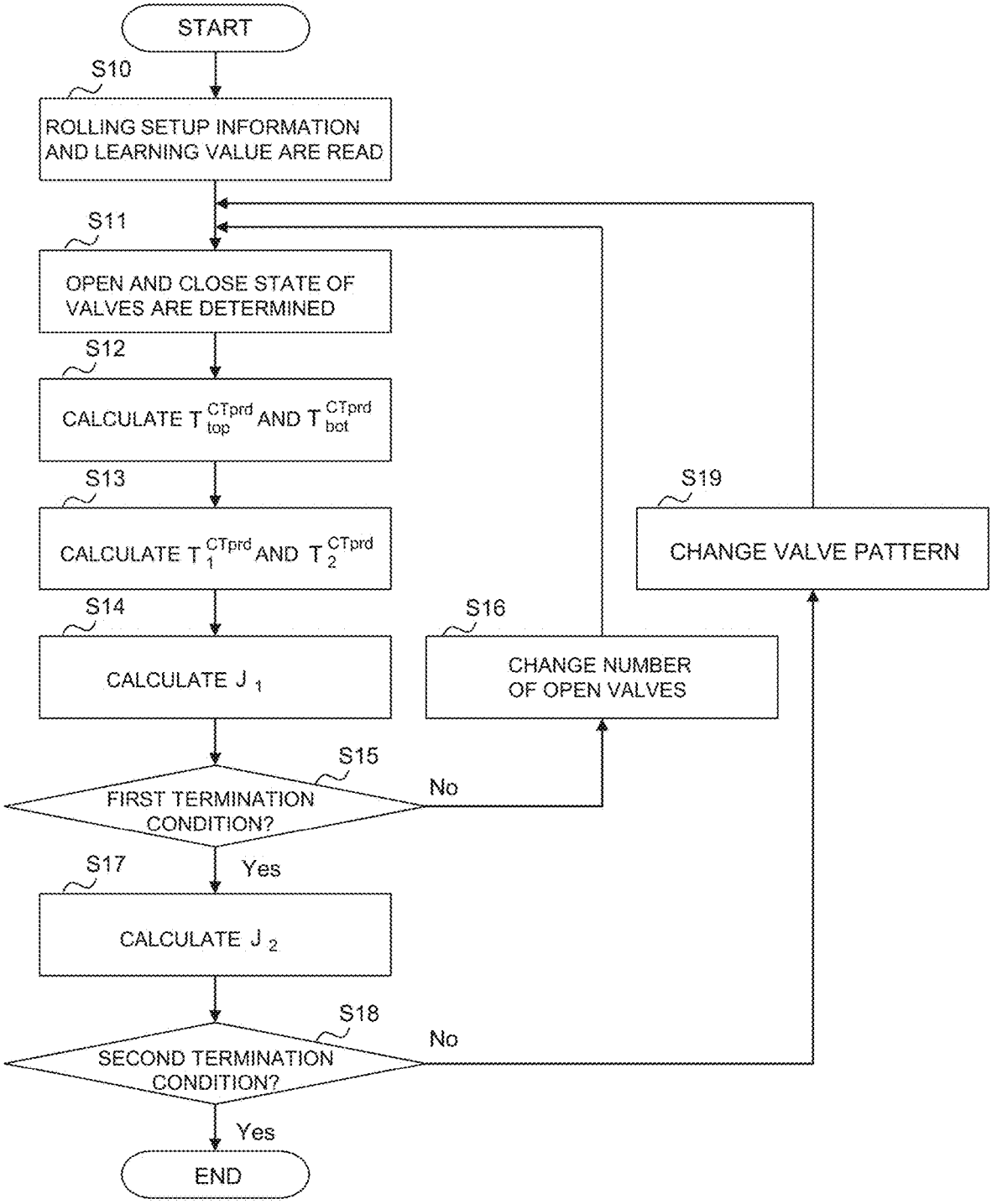
FIG. 6 is a flowchart illustrating an example of processing related to a calculation of a modified valve pattern executed by a setting calculation part.

FIG. 6 is a flowchart illustrating an example of processing related to the calculation of the modified valve pattern executed by the setting calculation part 23 (the processor 20*a*). In the routine shown in FIG. 6, first, the rolling setup information of the steel plate 1 and the information of the learning value corresponding to the steel plate 1 are read (step S10). Subsequently, the open and close states of the valves are determined based on the setting valve pattern and the number of open valves set in advance as a temporary setting for an iterative calculation (step S11).

Following the processing of step S11, the predicted value (the brief predicted value) $T_{top}^{CTprd}$ of the coiling top surface temperature $T_{top}^{CT}$ and the predicted value (the brief predicted value) $T_{bot}^{CTprd}$ of the coiling bottom surface temperature $T_{bot}^{CT}$ are calculated (step S12). The calculation of the brief predicted values $T_{top}^{CTprd}$ and $T_{bot}^{CTprd}$ is performed by applying parameters such as the rolling setup information read in the processing of step S10 and the measured value $T^{FDTact}$ acquired from the finisher delivery-side pyrometer 2 to the temperature model of the above Equation (1).

Following the processing of step S12, the predicted value (the brief predicted value) $T_1^{CT}$ of the first control index $T_1^{CTprd}$ and the predicted value (the brief predicted value) $T_2^{CT}$ of the second control index $T_2^{CTprd}$ are calculated (step S13). The calculation of the brief predicted values $T_1^{CTprd}$ and $T_2^{CTprd}$ is performed by applying the brief predicted values $T_{top}^{CTprd}$ and $T_{bot}^{CTprd}$ calculated in the processing of step S12 to the above Equations (2) and (3).

Following the processing of step S13, an evulsion function $T_1^{CT}$ of a first control index J1 is calculated (step S14). For example, the following Equation (5) is used for the calculation of the evaluation function J1. The value calculated in the process of step S13 is used for the predicted value $T_1^{CTprd}$ on the right-hand side of the following Equation (5). On the other hand, a value given from the index value calculation part 21 is used for the target value $T_1^{CTref}$.

[Equation 5]

$$J_1 = T_1^{CTprd} - T_1^{CTref} \tag{5}$$

Following the processing of step S14, it is determined whether or not the evaluation function J1 satisfies a first end condition (step S15). The first end condition is determined by, for example, whether or not the evaluation function J1 falls within a preset range. When it is determined that the first end condition is not satisfied, the number of open valves is changed (step S16), and the processing of step S11 is performed. In other words, the processing from steps S11 to S16 is repeatedly performed until it is determined that the first end condition is satisfied. The number of open valves is changed by, for example, increasing the number when the evaluation function J1 is positive and decreasing the number when the evaluation function J1 is negative.

When it is determined that the first end condition is satisfied, a evaluation function $T_2^{CT}$ of a second control index J2 is calculated (step S17). For example, the following Equation (6) is used for the calculation of the evaluation function J2. Note that the value calculated in the processing of step S13 is used for the predicted value $T_2^{CTprd}$ on the right-hand side of the following Equation (6). On the other hand, a value given from the index value calculation part 21 is used for the target value $T_2^{CTref}$

[Equation 6]

$$J_2 = \left|T_2^{CTprd} - T_2^{CTref}\right| \tag{6}$$

Following the processing of step S17, it is determined whether or not the evaluation function J2 satisfies a second end condition (step S18). The second end condition is determined by, for example, whether or not the evaluation function J2 falls within a preset range. When it is determined that the second end condition is not satisfied, the valve pattern is changed (step S19), and the process of step S12 is performed. In other words, the processing from steps S12 to S19 is repeatedly performed until it is determined that the second end condition is satisfied. The valve pattern is changed, for example, by rearranging the opening order such that the coolant injection amount in a specific region is rapidly increased and a rapid cooling does not occur and a ratio of the number of open valves of the top surface cooling valve 11 and the bottom surface cooling valve 14 in each cooling bank or in a preset cooling bank group is changed.

When it is determined that the second end condition is satisfied, the valve pattern when the second end condition is satisfied is set as the modified valve pattern, and the number of open valves is set as the initial number of open valves, and these pieces of information are output to the FF control calculation part 24 and the FB control calculation part 25. In addition, information on the open and close state of the valve calculated based on the modified valve pattern and the initial number of open valves is output to the valve control part 28.

During the execution of the setting processing, the FF control calculation part 24 acquires the rolling setup information of the steel plate 1 from the setup device 40. The FF control calculation part 24 also acquires information on the target values $T_1^{CTref}$ and $T_2^{CTref}$ from the index value calculation part 21. The FF control calculation part 24 further acquires information on the learning value corresponding to the steel plate 1 from the learning value storage part 27. The FF control calculation part 24 also acquires information on the modified valve pattern and the initial number of open valves for the FF banks from the setting calculation part 23.

During execution of the control processing, the FF control calculation part 24 calculates the open and close states of the valves included in the FF banks each time the measured value $T^{FDTact}$ of the piece CP is acquired from the finisher delivery-side pyrometer 2. The operation result of the open and close state is output to the valve control part 28.

Figure 7:
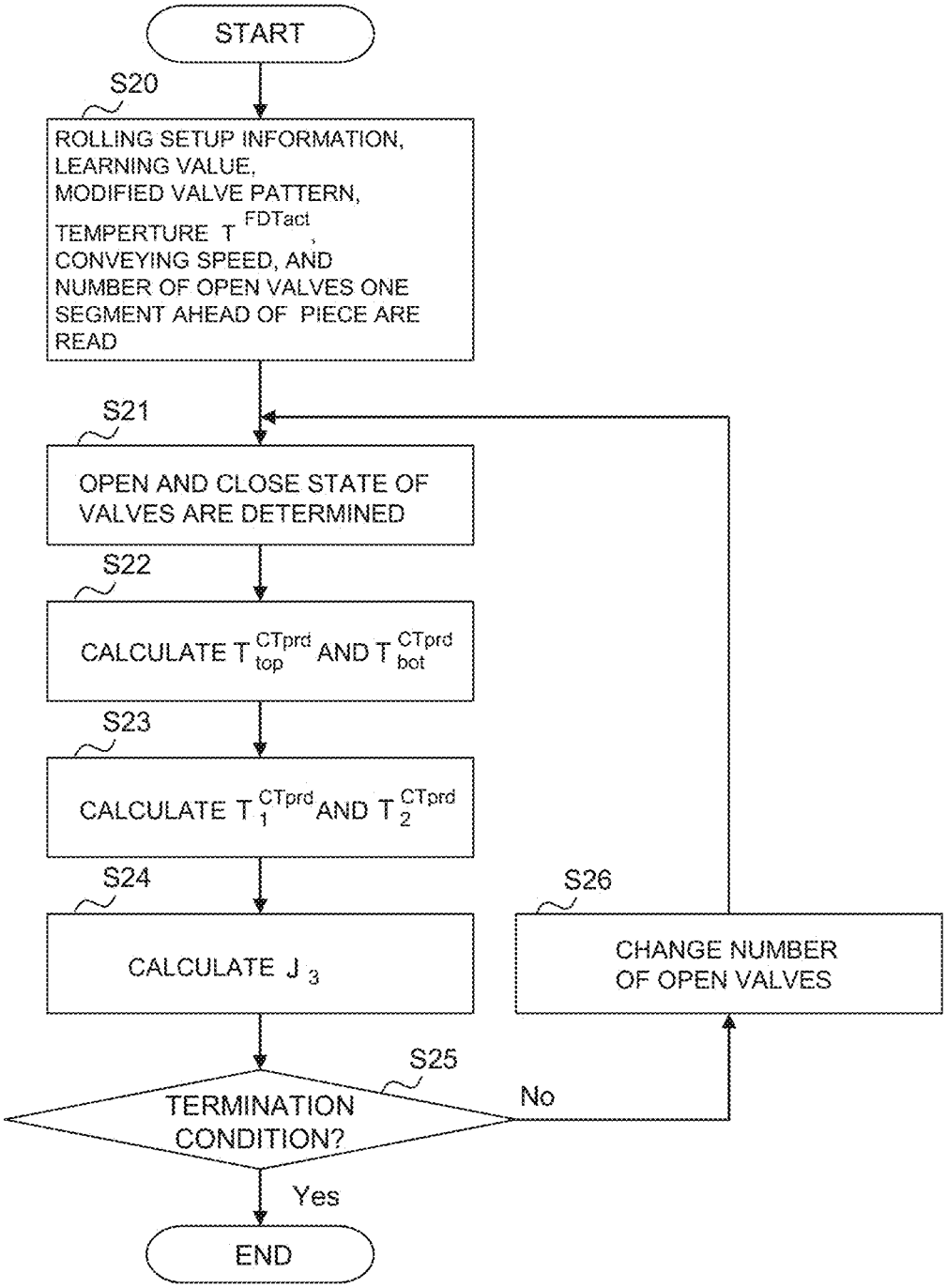
FIG. 7 is a flowchart illustrating an example of processing related to a calculation of open and close states of a valve with respect to a piece to be focused on, which is executed by an FF control calculation part.

FIG. 7 is a flowchart for illustrating an example of processing related to the calculation of the open and close state of the valve for the piece CPtgt to be focused on, which is executed by the FF control calculation part 24 (the processor 20*a*). In the routine shown in FIG. 7, the rolling setup information of the steel plate 1, the learned value information corresponding to the steel plate 1, the modified valve pattern information, the measured value $T^{FDTact}$ information, the conveying speed information of the steel plate 1, and the number of open valves for the piece CP one segment ahead of the piece CPtgt are read (step S20). When the piece CPtgt is the piece CP of the head end, the information of the initial number of open valves is used as the information of the number of open valves of the valve with respect to the piece CP one segment ahead of the piece CPtgt.

Following the processing of step S20, the open and close state of the valve for piece CPtgt is determined based on the modified valve pattern for the FF banks and the number of open valves of the valve for piece CP one segment before piece CPtgt (step S21).

Following the processing of step S21, the predicted value (the detailed prediction value) $T_{top}^{CTprd}$ of the coiling top surface temperature $T_{top}^{CT}$ and the predicted value (the detailed prediction value) $T_{bot}^{CTprd}$ of the coiling bottom surface temperature $T_{bot}^{CT}$ are calculated (step S22). The computation of the detailed prediction values $T_{top}^{CTprd}$ and $T_{bot}^{CTprd}$ is performed by applying parameters such as the rolling setup information read in the processing of step S20 and the measured value $T^{FDTact}$ acquired from the finisher delivery-side pyrometer 2 to the temperature model of the above Equation (1).

Following the processing of step S22, the predicted value (the detailed prediction value) $T_1^{CT}$ of the first control index $T_1^{CTprd}$ and the predicted value (the detailed prediction value) $T_2^{CT}$ of the second control index $T_2^{CTprd}$ are calculated (step S23). The calculation of the detailed prediction values $T_1^{CTprd}$ and $T_2^{CTprd}$ is performed by applying the detailed prediction values $T_{top}^{CTprd}$ and $T_{bot}^{CTprd}$ calculated in the processing of step S22 to the variables on the right-hand sides of the above Equations (2) and (3).

Following the processing of step S23, an evulsion function $T_1^{CT}$ of a first control index 3 is calculated (step S24). For example, the following Equation (7) is used for the calculation of the evaluation function J3. The value calculated in the processing of step S23 is used for the predicted value $T_1^{CTprd}$ on the right-hand side of the following Equation (7). On the other hand, a value given from the index value calculation part 21 is used for the target value $T_1^{CTref}$.

[Equation 7]

$$J_3 = T_1^{CTprd} - T_1^{CTref} \tag{7}$$

Following the processing of step S24, it is determined whether or not the evaluation function J3 satisfies a termination condition (step S25). The termination condition is determined by, for example, whether or not the evaluation function J3 falls within a preset range. When it is determined that the termination condition is not satisfied, the number of open valves is changed based on the evaluation function J3 (step S26), and the processing of step S21 is performed. That is, the processing from steps S21 to S26 is repeatedly performed until it is determined that the termination condition is satisfied. The number of open valves is changed based on the evaluation function J3, for example, by increasing the number of open valves one by one until the evaluation function J3 changes from a positive value to a negative value.

When it is determined that the termination condition is satisfied, information on the open and close state of the valve for the piece CPtgt when the termination condition is satisfied is output to the valve control part 28. In addition, information on the number of open valves when the termination condition is satisfied is stored for the calculation of the open and close state of the valve for the piece CP behind one segment from the piece CPtgt.

During the execution of the setting processing, the FB control calculation part 25 acquires the rolling setup information of the steel plate 1 from the setup device 40. The FB control calculation part 25 also acquires information on the target values $T_1^{CTref}$ and $T_2^{CTref}$ from the index value calculation part 21. The FB control calculation part 25 further acquires information on the learning values corresponding to the steel plate 1 from the learning value storage part 27. The FB control calculation part 25 further acquires information on the modified valve pattern and the initial number of open valves for the FB bank from the setting calculation part 23.

During execution of the control processing, the FB control calculation part 25 calculates the open and close states of the valves included in the FB banks every time the measured value $T^{FDTact}$ of the piece CP of the steel plate 1 is acquired from the finisher delivery-side pyrometer 2. The operation result of the open and close state is output to the valve control part 28.

Figure 8:
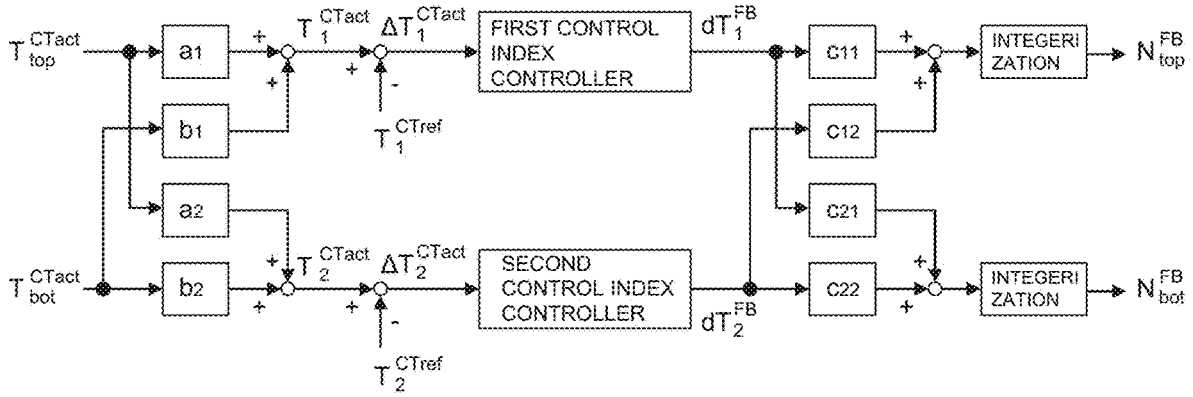
FIG. 8 is a diagram illustrating a control block of FB control performed by an FB control calculation part.

FIG. 8 is a diagram showing a control block of FB control performed by the FB control calculation part 25 (the processor 20*a*). As shown in FIG. 8, in the FB control, the measured value $T_1^{CT}$ of the first control index $T_1^{CTact}$ and the measured value $T_2^{CT}$ of the second control index $T_2^{CTact}$ are calculated based on the measured value $T_{top}^{FDTact}$ and $T_{bot}^{FDTact}$ (in the first embodiment, $T_{top}^{FDTact}=T_{bot}^{FDTact}=T^{FDTact}$) and the above Equations (2) and (3). In the FB control, a deviation $\Delta T_1^{CTact}$ of the first control index $T_1^{CT}$ and a deviation $\Delta T_2^{CT}$ of the second control index $T_2^{CT}$ are calculated based on the measured values $T_1^{CTtact}$ and $T_2^{CTact}$, the target values $T_1^{CTref}$ and $T_2^{CTref}$ and, and the following Equations (8) and (9).

[Equation 8]

$$\Delta T_1^{CTact} = T_1^{CTact} - T_1^{CTref} \tag{8}$$

[Equation 9]

$$\Delta T_2^{CTact} = T_2^{CTact} - T_2^{CTref} \tag{9}$$

The deviations $\Delta T_1^{CT}$ and $\Delta T_2^{CT}$ are input to controllers for the first control index $T_1^{CT}$ and the second control index $T_2^{CT}$, respectively. These controllers may comprise, for example, PID controllers.

A falling amount $dT_{top}^{FB}$ of the top surface temperature and a falling amount $dT_{bot}^{FB}$ of the bottom surface temperature of the steel plate 1 due to the coolant water from the FB banks are expressed by the following Equation (10) using the number $N_{top}^{FB}$ of open valves of the top surface cooling valve 11 and the number $N_{bot}^{FB}$ of open valves of the bottom surface cooling valve 14.

[Equation 10]

$$\begin{bmatrix} dT_{top}^{FB} \\ dT_{bot}^{FB} \end{bmatrix} = F \begin{bmatrix} N_{top}^{FB} \\ N_{bot}^{FB} \end{bmatrix} \tag{10}$$

In Equation (10), F is a matrix for calculating the falling amounts $dT_{top}^{FB}$ and $dT_{bot}^{FB}$ from the numbers $N_{top}^{FB}$ and $N_{bot}^{FB}$. The matrix F can be obtained, for example, by a linearization based on a sensitivity analysis of the temperature model of the above Equation (1) in which the rolling setup information corresponding to the steel plate 1 is set. In another example, the matrix F is obtained by, for example, a statistical analysis of actual data on a past steel plate rolled under the same rolling condition as the rolling condition of the steel plate 1, an index from a table value based on a preliminarily analyzed rolling condition, and a sequential calculation of a matrix locally linearized in the vicinity of the current state using the temperature model. When the sequential calculation is not performed, a correction term related to the conveying speed may be provided in consideration of an influence of the conveying speed of the steel plate 1. In addition, the matrix F may be expressed using a differential equation or a difference equation so as to take past values into consideration in consideration of a temporal change due to heat conduction.

Next, in the FB control, the numbers of the open valves $N_{top}^{FB}$ and $N_{bot}^{FB}$ are calculated based on a change amount $T_1^{CT}$ of the first control index $dT_1^{CT}$ and a change amount $T_2^{CT}$ of the second control index $dT_2^{CT}$ output by the controller and the following Equations (11) and (12), respectively.

[Equation 11]

$$\begin{bmatrix} N_{top}^{FB} \\ N_{bot}^{FB} \end{bmatrix} = C \begin{bmatrix} dT_1^{FB} \\ dT_2^{FB} \end{bmatrix} \tag{11}$$

[Equation 12]

$$C = F^{-1}A^{-1} \tag{12}$$

In Equation (12), C is a coefficient matrix for converting the change amounts $dT_1^{CT}$ and $dT_2^{CT}$ into falling amounts $dT_{top}^{FB}$ and $dT_{bot}^{FB}$, respectively, by an inverse matrix $A^{-1}$ of the matrix A shown in Equation (4) above, and converting the falling amounts into the numbers $N_{top}^{FB}$ and $N_{bot}^{FB}$, respectively, by an inverse matrix $F^{-1}$ of the matrix F shown in Equation (10) above. Elements in the i-th row and the j-th column of the matrix C correspond to $c_{11}$ to $c_{22}$ illustrated in FIG. 8.

In the FB control, finally, the calculated numbers $N_{top}^{FB}$ and $N_{bot}^{FB}$ are converted into integers. According to this integerization, it is possible to prevent the FB control for the first control index $T_1^{CT}$ and the FB control for the second control index $T_2^{CT}$ from interfering with each other.

The FB control calculation part 25 calculates the open and close states of the valves included in the FB banks based on the integerized numbers $N_{top}^{FB}$ and $N_{bot}^{FB}$ and the modified valve pattern for the FB banks. The operation result of the open and close state is output to the valve control part 28.

Figure 9:
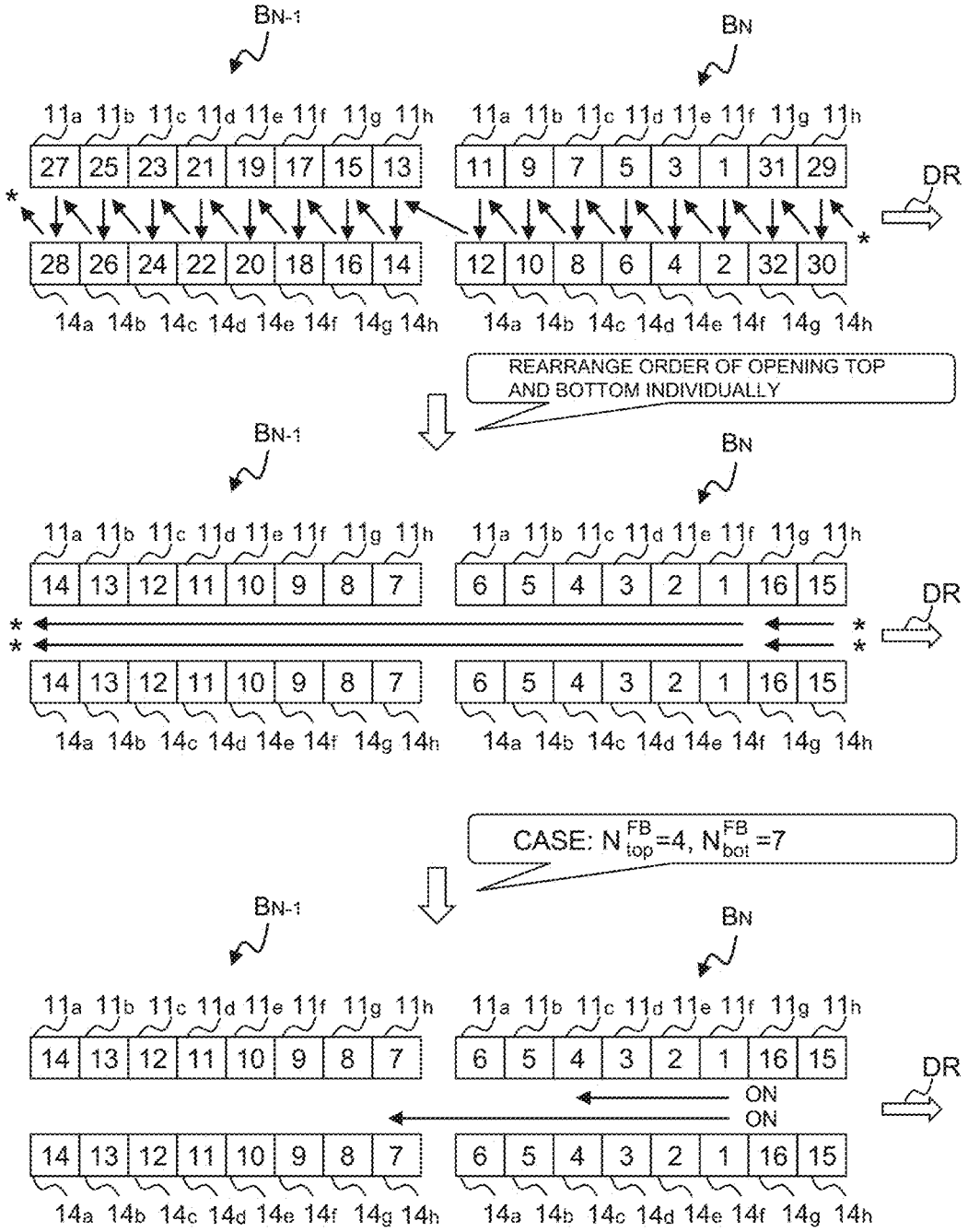
FIG. 9 is a diagram for explaining an example of a method to calculate the open and close states of the valve.

FIG. 9 is a diagram for explaining an example of a calculation method of the open and close states of the valve. In the upper part of FIG. 9, the setting valve pattern of the cooling banks $B_{N-1}$ to $B_N$ as the FB banks is illustrated. In the example shown in FIG. 9, the modified valve pattern is calculated. In the modified valve pattern, the opening order of the top surface cooling valve 11 is different from that of the bottom surface cooling valve 14, and the opening order of the top surface cooling valve 11 and that of the bottom surface cooling valve 14 are individually rearranged. The middle part of FIG. 9 illustrates the valve pattern after the opening order is rearranged (i.e., the modified valve pattern). When the numbers $N_{top}^{FB}$ and $N_{bot}^{FB}$ are calculated, the open valve is selected in accordance with the modified valve pattern.

In the lower part of FIG. 9, an example of selecting the open valve when the number $N_{top}^{FB}=4$ and the number $N_{bot}^{FB}=7$ is shown. In the example at the bottom of FIG. 9, the top surface cooling valves 11*f*, 11*e*, 11*d*, and 11*c* of the cooling bank $B_N$ are opened. In addition, the bottom surface cooling valves 14*f*, 14*e*, 14*d*, 14*c*, 14*b*, and 14*a* of the cooling bank $B_N$ and the bottom surface cooling valve 14*h* of the cooling bank $B_{N-1}$ are opened.

During the execution of the setting processing, the valve control part 28 operates the plurality of valves included in the cooling banks $B_1$ to $B_N$ in accordance with the information of the initial open and close states of the valves of the cooling banks $B_L$ to $B_N$ given from the setting calculation part 23.

During the execution of the control processing, the valve control part 28 operates the plurality of valves included in the FF banks based on the information of respective positions of the piece CPs given from the tracking calculation part 22 and the information of the open and close states of the valves of the FF banks given from the FF control calculation part 24. The valve control part 28 also operates a plurality of valves included in the FB banks based on the information of respective positions of the piece CPs and the information of the open and close states of the valves of the FB banks given from the FB control calculation part 25. The valve control part 28 further outputs a valve operation result information to the learning value calculation part 26.

During the execution of the setting processing, the learning value calculation part 26 acquires the rolling setup information of the steel plate 1 from the setup device 40. The learning value calculation part 26 also acquires information on the target values $T_1^{CTref}$ and $T_2^{CTref}$ from the index value calculation part 21. The learning value calculation part 26 further acquires information on the learning values corresponding to the steel plate 1 from the learning value storage part 27.

During the execution of the control processing, the learning value calculation part 26 acquires and temporarily stores the measured value $T^{FDTact}$, the measured value $T_{top}^{CTact}$, and the measured value $T_{bot}^{CTact}$ for respective piece CPs. The learning value calculation part 26 also acquires and temporarily stores information on respective positions of the piece CPs, information on the conveying speed of the steel plate 1, and information on the operation result of the valve.

During the execution of the learn processing, the learning value calculation part 26 calculates a predicted value (a predicted value for learning) $T_{top}^{CTprd}$ of the coiling top surface temperature $T_{top}^{CT}$ and a predicted value (a predicted value for learning) $T_{bot}^{CTprd}$ of the coiling bottom surface temperature $T_{bot}^{CT}$ based on the rolling setup information given from the setup device 40, the information of the learning value corresponding to the steel plate 1, the various information temporarily stored during the control processing, and the temperature model. The learning value calculation part 26 also performs an evaluation on the predicted values for learning $T_{top}^{CTprd}$ and $T_{bot}^{CTprd}$. This evaluation is performed using, for example, an evaluation function J4 represented by the following Equation (13). In Equation (13), h means the number of piece CP.

[Equation 13]

$$J_4 = \sum_{h=1}^{M} \left\{ \left(T_{top}^{CTprd}[h] - T_{top}^{CTact}[h]\right)^2 + \left(T_{bot}^{CTprd}[h] - T_{bot}^{CTact}[h]\right)^2 \right\} \tag{13}$$

In the evaluation of the predicted values for learning $T_{top}^{CTPrd}$ and $T_{bot}^{CTPrd}$, it is determined whether the evaluation function J4 satisfies a termination condition. The termination condition is determined by, for example, whether or not both of the evaluation function J4 in the previous evaluation and the evaluation function J4 in the current evaluation are equal to or less than a preset value. In a case where it is determined that the termination condition is not satisfied, the learning values are updated based on the evaluation function J4, the predicted values for learning $T_{top}^{CTprd}$ and $T_{bot}^{CTprd}$ are calculated, and the evaluation using the above Equation (13) is performed. For example, a quasi-Newton method known as an optimization method can be applied to the method of updating the learning values based on the evaluation function. The calculation of the predicted values, the evaluation using the evaluation function, and the update of the learning values are repeated until the termination condition is satisfied. When the termination condition is satisfied, a value obtained by proportionally dividing the learning value when the termination condition is satisfied and the learning value corresponding to the steel plate 1 is calculated as a final learning value. This final learning value is recorded in the learning value storage part 27.

2. Second Embodiment

In the second embodiment, in the calculation of the open and close states of the valve performed by the FB control calculation part 25 in the first embodiment, deviations $\Delta T_1^{CTsmt}$ and $\Delta T_2^{CTsmt}$ by Smith-prediction represented by the following Equations (14) and (15) are calculated instead of the Equations (8) and (9). The deviations $\Delta T_1^{CTsmt}$ and $\Delta T_2^{CTsmt}$ are input to the controller (see FIG. 8) for the first control index $T_1^{CT}$ and the second control index $T_2^{CT}$, respectively.

[Equation 14]

$$\Delta T_1^{CTsmt} = \left(T_1^{CTsmt1} + T_1^{CTact} - T_1^{CTsmt2}\right) - T_1^{CTref} \tag{14}$$

[Equation 15]

$$\Delta T_2^{CTsmt} = \left(T_2^{CTsmt1} + T_2^{CTact} - T_2^{CTsmt2}\right) - T_2^{CTref} \tag{15}$$

The Smith predictor calculates a predicted value $T_{top}^{CTsmt1}$ of the coiling top surface temperature $T_{top}^{CT}$ and a predicted value $T_{bot}^{CTsmt1}$ of the coiling bottom surface temperature $T_{bot}^{CT}$ for the piece CPtgt entering the cooling bank $B_{j+1}$ (i.e., the piece CP located between the cooling bank $B_j$ and the cooling bank $B_{j+1}$). The predicted values $T_{top}^{CTsmt1}$ and $T_{bot}^{CTsmt1}$ are calculated based on the measured value $T^{FDTact}$ when the piece CPtgt passes the position of the finisher delivery-side pyrometer 2, the open and close state of the valve (the actual open and close state of the piece CPtgt for the FF valve, and the open and close state calculated for the piece CP one segment before the piece CPtgt for the FB valve), and the conveying speed.

When the predicted values $T_{top}^{CTsmt1}$ and $T_{bot}^{CTsmt1}$ are calculated, a predicted value (a smith predicted value) $T_1^{CT}$ of the first control index $T_1^{CTsmt1}$ and a predicted value (a smith predicted value) $T_2^{CT}$ of the second control index $T_2^{CTsmt1}$ are calculated based on the predicted values and the following Equation (16).

[Equation 16]

$$\begin{bmatrix} T_1^{CTsmt1} \\ T_2^{CTsmt1} \end{bmatrix} = A \begin{bmatrix} T_{top}^{CTsmt1} \\ T_{bot}^{CTsmt1} \end{bmatrix} \tag{16}$$

In Equation (16), A is the coefficient matrix shown in Equation (4). In order to take into account a dead time delay due to conveyance, errors between the measured values $T_{top}^{CTact}$ and $T_{bot}^{CTact}$ for the piece CP located immediately below the coiler entry-side top surface pyrometer 3 (or immediately above the coiler entry-side bottom surface pyrometer 4) and the predicted value (the smith predicted value) $T_1^{CTsmt2}$ of the first control index $T_1^{CT}$ and the predicted value (the smith predicted value) $T_2^{CT}$ of the second control index $T_2^{CTsmt2}$ represented by the following Equation (17) are calculated. The predicted values $T_1^{CTsmt2}$ and $T_2^{CTsmt2}$ are predicted values for the piece CP that has entered the cooling bank $B_{j+1}$ before the piece CPtgt by a dead time Td seconds.

[Equation 17]

$$\begin{bmatrix} T_1^{CTsmt2}(t) \\ T_2^{CTsmt2}(t) \end{bmatrix} = \begin{bmatrix} T_1^{CTsmt1}(t - T_d) \\ T_2^{CTsmt1}(t - T_d) \end{bmatrix} \tag{17}$$

Once the errors between the measured values $T_{top}^{CTact}$ and $T_{bot}^{CTact}$ and the smith predicted values $T_1^{CTsmt2}$ and $T_2^{CTsmt2}$ are calculated, these errors are used to correct the predicted values $T_{top}^{CTsmt1}$ and $T_{bot}^{CTsmt1}$. The above Equations (14) and (15) represent a series of calculations.

3. Third Embodiment

Figure 10:
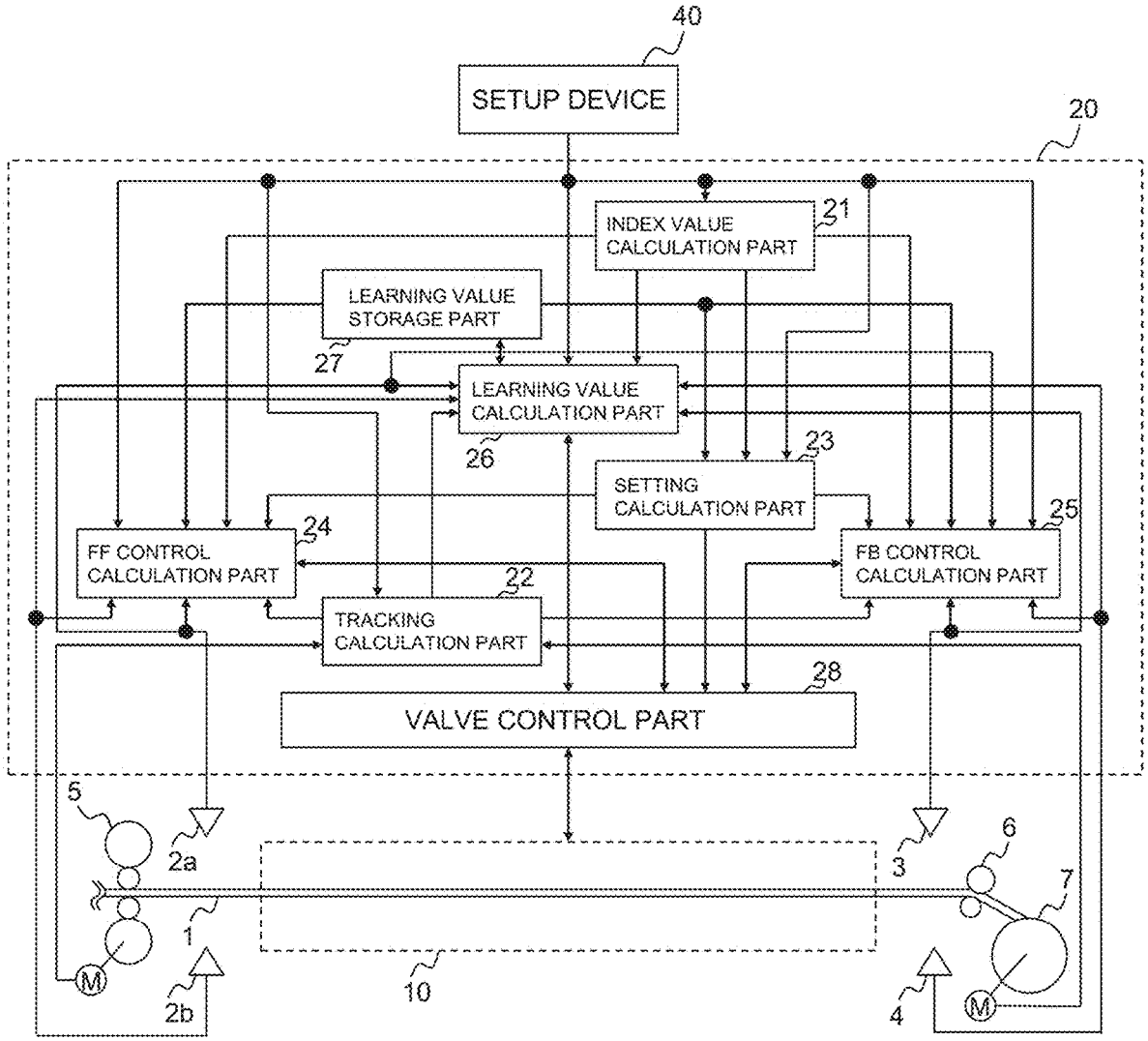
FIG. 10 is a diagram for explaining a configuration example of a hot rolling line to which a temperature control device according to a third embodiment is applied.

FIG. 10 is a diagram for explaining a configuration example of a hot rolling line to which the temperature control device according to a third embodiment is applied. The difference between the configuration example shown in FIG. 10 and that shown in FIG. 1 is a pyrometer on the delivery side of the final stand of the finishing mill 5. That is, while the configuration example shown in FIG. 1 has only one finisher delivery-side pyrometer 2, the configuration example shown in FIG. 10 has a finisher delivery side top surface pyrometer 2*a* and a finisher delivery side bottom surface pyrometer 2*b*.

In the third embodiment, the measured values $T_{top}^{FDTact}$ and $T_{bot}^{FDTact}$ are used for the calculations by the FF control calculation part 24 and the learning value calculation part 26 in the first embodiment and the calculations of the predicted values $T_{top}^{CTsmt1}$ and $T_{bot}^{CTsmt1}$ based on the temperature model in the FB control calculation part 25 in the second embodiment. Therefore, it is possible to improve the calculation accuracy of various predicted values compared to the first embodiment.

4. Fourth Embodiment

Figure 11:
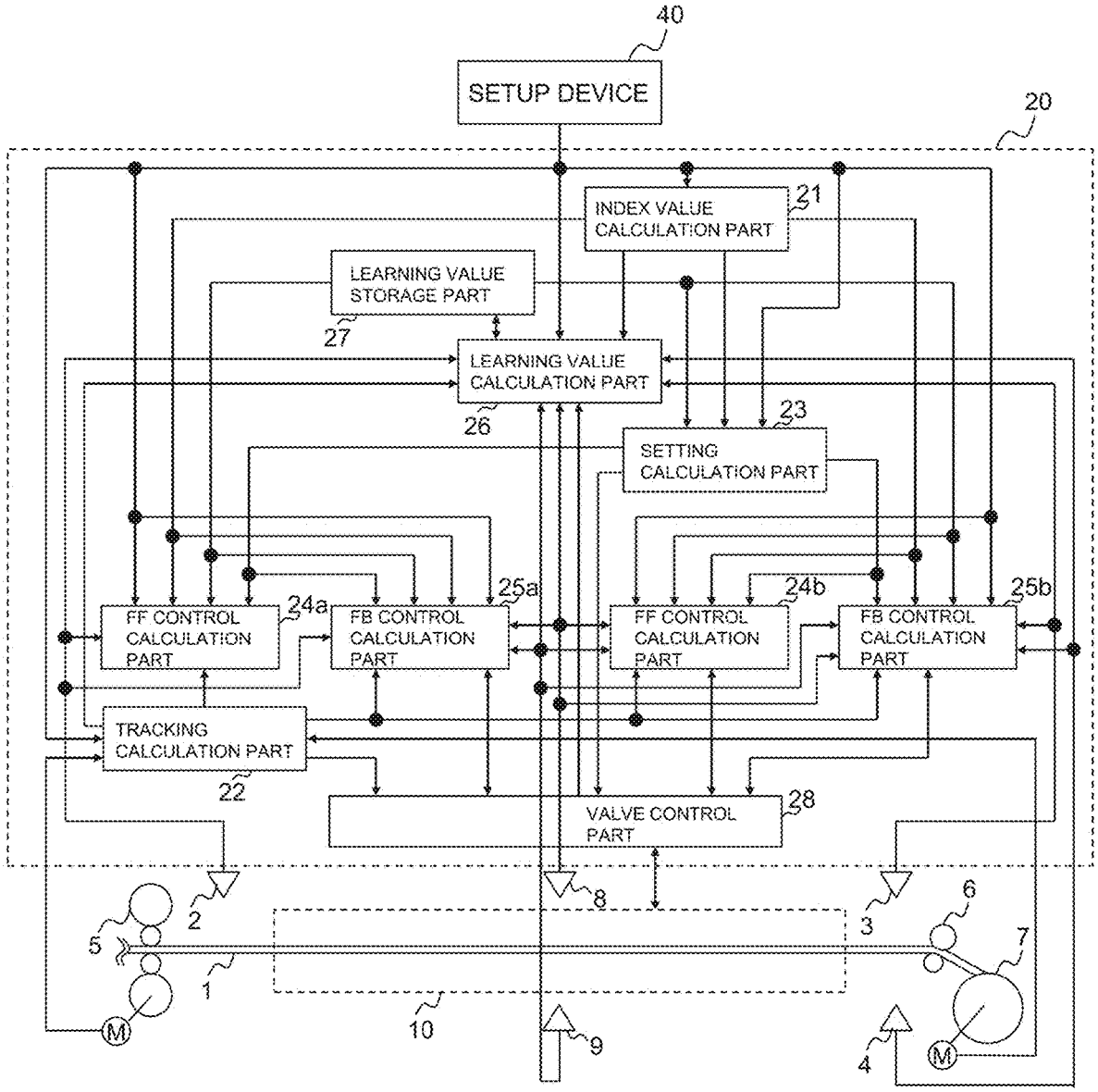
FIG. 11 is a diagram for explaining a configuration example of a hot rolling line to which a temperature control device according to a fourth embodiment is applied and a functional configuration example of the temperature control device.

FIG. 11 is a diagram for explaining a configuration example of a hot rolling line to which the temperature control device according to the fourth embodiment is applied and a functional configuration example of the temperature control device. FIG. 11 shows an intermediate top surface pyrometer 8 and a middle bottom surface pyrometer 9. The intermediate top surface pyrometer 8 and the middle bottom surface pyrometer 9 are provided on the delivery side of the cooling bank $B_1$ ($2 \leq 1 \leq N-2$). The intermediate top surface pyrometer 8 measures the temperature (hereinafter also referred to as a "middle top surface temperature $T_{top}^{MT}$" or a "temperature $T_{top}^{MT}$") of the steel plate 1 passing immediately below the intermediate top surface pyrometer 8, and outputs the measured value $T_{top}^{MTact}$ to the temperature control device 20. The middle bottom surface pyrometer 9 measures the temperature (hereinafter also referred to as a "middle bottom surface temperature $T_{bot}^{MT}$" or a "temperature $T_{bot}^{MT}$") of the steel plate 1 passing immediately above the middle bottom surface pyrometer 9, and outputs the measured value $T_{bot}^{MTact}$ to the temperature control device 20.

The temperature control device 20 shown in FIG. 11 includes FF control calculation parts 24*a* and 24*b* and FB control calculation parts 25*a* and 25*b* as functions in place of the FF control calculation part 24 and the FB control calculation part 25 shown in FIG. 4. However, the basic functions of the FF control calculation parts 24*a* and 24*b* are the same as those of the FF control calculation part 24 shown in FIG. 4. The basic functions of the FB control calculation parts 25*a* and 25*b* are the same as those of the FB control calculation part 25 shown in FIG. 4.

Figure 12:
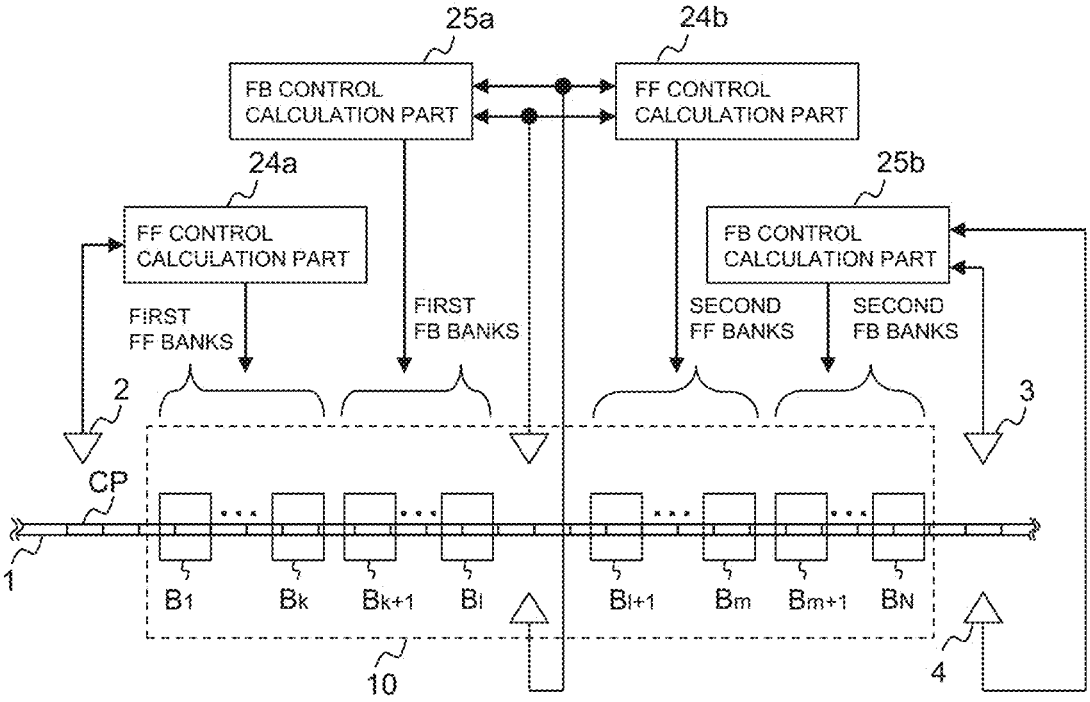
FIG. 12 is a diagram for explaining a configuration example of a cooling bank in the fourth embodiment.

FIG. 12 is a diagram for explaining a configuration example of the cooling banks $B_1$ to $B_N$ in the fourth embodiment. In the example shown in FIG. 12, cooling banks $B_1$ to $B_k$, cooling banks $B_{k+1}$ to $B_L$, cooling banks $B_{l+1}$ to $B_m$, and cooling banks $B_{m+1}$ to $B_N$ are arranged in this order from the upstream side of the cooling facility 10 ($1 \leq k < 1 < m \leq N-1$). The cooling banks $B_1$ to $B_k$ and $B_{l+1}$ to $B_m$ correspond to the FF banks. The cooling banks $B_{k+1}$ to $B_l$ and $B_{m+1}$ to $B_N$ correspond to the FB banks.

Hereinafter, when the cooling banks $B_1$ to $B_k$ are not particularly distinguished from each other, they are collectively referred to as "first FF banks", and when the cooling bank group $B_{l+1}$ to $B_m$ are not particularly distinguished from each other, they are collectively referred to as "second FF banks". When the cooling banks $B_{k+1}$ to Bl are not particularly distinguished from each other, they are collectively referred to as "first FB banks", and when the cooling banks $B_{m+1}$ to $B_N$ are not particularly distinguished from each other, they are collectively referred to as "second FB banks".

Returning to FIG. 11, the description of the functional configuration example of the temperature control device 20 will be continued. In the first embodiment, calculations in the setting calculation part 23, the FF control calculation part 24, and the FB control calculation part 25 are performed based on the target value $T_1^{CT}$ of the first control index $T_1^{CTref}$ and the target value $T_2^{CT}$ of the second control index $T_2^{CTref}$. The target values $T_1^{CTref}$ and $T_2^{CTref}$ are also used in the fourth embodiment. In the fourth embodiment, the target values of the first and second control indexes for the intermediate temperature are also used.

The target value $T^{MT}$ of the first control index $T_1^{MTref}$ and the target value $T_2^{MT}$ of the second control index $T_2^{MTref}$ related to the intermediate temperature are calculated according to, for example, the following Equation (18).

[Equation 18]

$$\begin{bmatrix} T_1^{MT} \\ T_2^{MT} \end{bmatrix} = A \begin{bmatrix} T_{top}^{MT} \\ T_{bot}^{MT} \end{bmatrix} \tag{18}$$

In Equation (18), A matches the matrix A shown in Equation (4) above. The target values $T_1^{MTref}$ and $T_2^{MTref}$ are calculated by applying the measured values $T_{top}^{MTact}$ and $T_{bot}^{MTact}$ to the variables on the right-hand side of Equation (18).

In order to distinguish the target values $T_1^{CTref}$ and $T_2^{CTref}$ from the target values $T_1^{MTref}$ and $T_2^{MTref}$, in the following, the target values $T_1^{CTref}$ and $T_2^{CTref}$ are also referred to as "final target values $T_1^{CTref}$ and $T_2^{CTref}$", and the target values $T_1^{MTref}$ and $T_2^{MTref}$ are also referred to as "intermediate target values $T_1^{MTref}$ and $T_2^{MTref}$".

The FF control calculation part 24*a* calculates open and close states of a plurality of valves included in the first FF banks and outputs the calculated open and close states to the valve control part 28. The FF control calculation part 24*b* calculates open and close states of a plurality of valves included in the second FF banks and outputs the calculated open and close states to the valve control part 28. The FB control calculation part 25*a* calculates open and close states of a plurality of valves included in the first FB banks and outputs the calculated open and close states to the valve control part 28. The FB control calculation part 25*b* calculates open and close states of a plurality of valves included in the second FB banks and outputs the calculated open and close states to the valve control part 28.

During execution of the setting processing, the FF control calculation part 24*a* acquires the rolling setup information from the setup device 40. The FF control calculation part 24*a* also acquires information on the intermediate target values $T_1^{MTref}$ and the $T_2^{MTref}$ from the index value calculation part 21. The FF control calculation part 24 further acquires information on the modified valve pattern and the initial number of open valves for the first FF banks from the setting calculation part 23. Furthermore, the FF control calculation part 24*a* acquires information of learning values related to "first temperature model" corresponding to the steel plate 1 from the learning value storage part 27. Here, the first temperature model is expressed by, for example, the following Equation (19).

[Equation 19]

$$\begin{bmatrix} T_{top}^{MTprd} \\ T_{bot}^{MTprd} \end{bmatrix} = f\left(T_{top}^{FDT}, T_{bot}^{FDT}, X_1, X_2, \ldots, X_N, z_{top}^{MT}, z_{bot}^{MT}\right) \tag{19}$$

The variables on the right-hand side of the Equation (19) are basically common to the variables on the right-hand side of the Equation (1). Here, the learning value $z_{top}^{MT}$ is a learning value related to the middle top surface temperature $T_{top}^{MT}$, and $z_{bot}^{MT}$ is a learning value related to the middle bottom surface temperature $T_{bot}^{MT}$.

During the control processing, the FF control calculation part 24*a* calculates the open and close state of the valve included in the first FF banks every time the measured value $T^{FDTact}$ of piece CP is acquired from the finisher delivery-side pyrometer 2. The operation result of the open and close state is output to the valve control part 28. In the calculation of the open and close state of the valve, "the FF control calculation part 24" is read as "the FF control calculation part 24*a*" and "the FF banks" are read as "the first FF banks" in the description of FIG. 7. In addition, "the first control index $T_1^{CT}$" is read as "the first control index $T_1^{MT}$", "the second control index $T_2^{CT}$" is read as "the second control index $T_2^{MT}$", and "the detailed prediction values $T_{top}^{CTprd}$ and $T_{bot}^{CTprd}$" are read as "the predicted values (detailed prediction values) $T_{top}^{MTprd}$ and $T_{bot}^{MTprd}$". Further, "the temperature model in the above Equation (1)" is read as "the first temperature model in the above Equation (19)", and "the target value $T_1^{CTref}$" is read as "the target value $T_1^{MTref}$". In this way, an example of processing related to the calculation of the open and close states of the valves included in the first FF banks will be described.

During the execution of the setting processing, the FB control calculation part 25*a* acquires the rolling setup information of the steel plate 1 from the setup device 40. The FB control calculation part 25*a* also acquires information on the target values $T_1^{MTref}$ and the $T_2^{MTref}$ from the index value calculation part 21. The FB control calculation part 25*a* further acquires information on the learning values corresponding to the steel plate 1 from the learning value storage part 27. Furthermore, the FB control calculation part 25*a* acquires information on the modified valve pattern and the initial number of open valves for the first FB banks from the setting calculation part 23.

During the execution of the control processing, the FB control calculation part 25*a* calculates the open and close states of the valves included in the first FB banks every time the measured value $T^{FDTact}$ of the piece CP of the steel plate 1 is acquired from the finisher delivery-side pyrometer 2. The operation result of the open and close state is output to the valve control part 28. In the calculation of the open and close state of the valve, "the FB control calculation part 25" is read as "the FB control calculation part 25*a*" and "the FB banks" are read as "the first FB banks" in the description of FIG. 8. In addition, "the first control index $T_1^{CT}$" is read as "the first control index $T_1^{MT}$", and "the second control index $T_2^{CT}$" is read as "the second control index $T_2^{MT}$". Further, "the measured values $T_1^{CTact}$ and $T_2^{CTact}$" are read as "the measured values $T_1^{MTact}$ and $T_2^{MTact}$", "the target values $T_1^{CTref}$ and $T_2^{CTref}$" are read as "the target values $T_1^{MTref}$ and $T_2^{MTref}$", "the deviations $\Delta T_1^{CT}$ and $\Delta T_2^{CT}$" are read as "the deviations $\Delta T^{MT}$ and $\Delta T_2^{MT}$", and "the change amounts $dT_1^{CT}$ and $dT_2^{CT}$" are read as "the change amount $dT_1^{MT}$ and $dT_2^{MT}$". In this way, an example of processing related to the calculation of the open and close states of the valves included in the first FF banks will be described.

During execution of the setting processing, the FF control calculation part 24*b* acquires the rolling setup information from the setup device 40. The FF control calculation part 24*b* also acquires information on the target values $T_1^{CTref}$ and $T_2^{CTref}$ from the index value calculation part 21. The FF control calculation part 24*b* further acquires information on the modified valve pattern and the initial number of open valves for the second FF banks from the setting calculation part 23. Furthermore, the FF control calculation part 24*b* acquires information of a learning value related to a "second temperature model" corresponding to the steel plate 1 from the learning value storage part 27. Here, the second temperature model is expressed by, for example, the following Equation (20).

[Equation 20]

$$\begin{bmatrix} T_{top}^{CTprd} \\ T_{bot}^{CTprd} \end{bmatrix} = f\left(T_{top}^{MT}, T_{bot}^{MT}, X_1, X_2, \ldots, X_N, z_{top}^{CT}, z_{bot}^{CT}\right) \tag{20}$$

The variables on the right-hand side of Equation (20) are basically the same as the variables on the right-hand side of Equation (1). However, the measured value $T_{top}^{MTact}$ of the middle top surface temperature $T_{top}^{MT}$ is input to $T_{top}^{MT}$ of Equation (20), and the measured value $T_{bot}^{MTact}$ of the middle bottom surface temperature $T_{bot}^{MT}$ is input to $T_{bot}^{MT}$ of Equation (20).

During the control processing, the FF control calculation part 24*b* calculates the open and close states of the valves included in the second FF banks every time the measured values $T_{top}^{MTact}$ and $T_{bot}^{MTact}$ of respective piece CPs are acquired from the intermediate top surface pyrometer 8 and the middle bottom surface pyrometer 9. The operation result of the open and close state is output to the valve control part 28. In the calculation of the open and close state of the valve, "the FF control calculation part 24" is read as "the FF control calculation part 24*b*" and "the FF banks" are read as "the second FF banks" in the description of FIG. 7. Further, "the temperature model of the above Equation (1)" is read as "the second temperature model of the above Equation (20)". In this way, an example of a process related to the calculation of the open and close states of the valves included in the second FF banks will be described.

During the execution of the setting processing, the FB control calculation part 25*b* acquires the rolling setup information of the steel plate 1 from the setup device 40. The FB control calculation part 25*b* also acquires information on the target values $T_1^{CTref}$ and $T_2^{CTref}$ from the index value calculation part 21. The FB control calculation part 25 further acquires information on the learning values corresponding to the steel plate 1 from the learning value storage part 27. Furthermore, the FB control calculation part 25*b* acquires information on the modified valve pattern and the initial number of open valves for the second FB banks from the setting calculation part 23.

During execution of the control processing, the FB control calculation part 25*b* calculates the open and close states of the valves included in the second FB banks every time the measured values $T_{top}^{MTact}$ and $T_{bot}^{MTact}$ of the piece CP are acquired from the intermediate top surface pyrometer 8 and the middle bottom surface pyrometer 9. The operation result of the open and close state is output to the valve control part 28. In the calculation of the open and close state of the valve, "the FB control calculation part 25" is read as "the FB control calculation part 25*b*" and "the FB banks" are read as "the second FB banks" in the description of FIG. 8. In this way, an example of a process related to the calculation of the open and close states of the valves included in the second FB banks will be described.

The learning value storage part 27 separately stores a learning value related to the first temperature model and a learning value related to the second temperature model.

During the execution of the control processing, the learning value calculation part 26 acquires the measured value $T_{top}^{MTact}$ from the intermediate top surface pyrometer 8 and the measured value $T_{bot}^{MTact}$ from the middle bottom surface pyrometer 9, and temporarily stores them.

During the execution of the learn processing, the learning value calculation part 26 is provided with the learning value for the first temperature model from the learning value storage part 27. The learning value calculation part 26 also calculates the predicted value (the predicted value for learning) $T_{top}^{MTprd}$ of the middle top surface temperature $T_{top}^{MT}$ and the predicted value (the predicted value for learning) $T_{bot}^{MTprd}$ of the middle bottom surface temperature $T_{bot}^{MT}$. The learning value calculation part 26 further evaluates the predicted values for learning $T_{top}^{MTprd}$ and $T_{bot}^{MTprd}$. This evaluation is performed using, for example, an evaluation function J5 represented by the following Equation (21). In Equation (21), h means the number of piece CP.

[Equation 21]

$$J_5 = \sum_{h=1}^{M} \left\{ \left(T_{top}^{MTprd}[h] - T_{top}^{MTact}[h]\right)^2 + \left(T_{bot}^{MTprd}[h] - T_{bot}^{MTact}[h]\right)^2 \right\} \tag{21}$$

The manner of the evaluation on the predicted values for learning $T_{top}^{CTprd}$ and $T_{bot}^{CTprd}$ is the same as that of evaluation on the predicted values for learning $T_{top}^{CTprd}$ and $T_{bot}^{CTprd}$ in the first embodiment. Further, the method of determining and updating the learning value related to the first temperature model is the same as the method of determining and updating the learning value related to the temperature model in the first embodiment.

During the execution of the learn processing, the learning value calculation part 26 determines and updates the learning value related to the second temperature model. The method of determining and updating the learned value related to the second temperature model is the same as the method of determining and updating the learned value related to the temperature model in the first embodiment.

In the fourth embodiment, a pair of the intermediate top surface pyrometer 8 and the middle bottom surface pyrometer 9 is installed in the ROT. However, the total number of the pair of intermediate temperature meters may be two or more, and in this case, the target value, brief predicted value, detailed prediction value, and the like are appropriately calculated in accordance with the description of the fourth embodiment.

5. Fifth Embodiment

Figure 13:
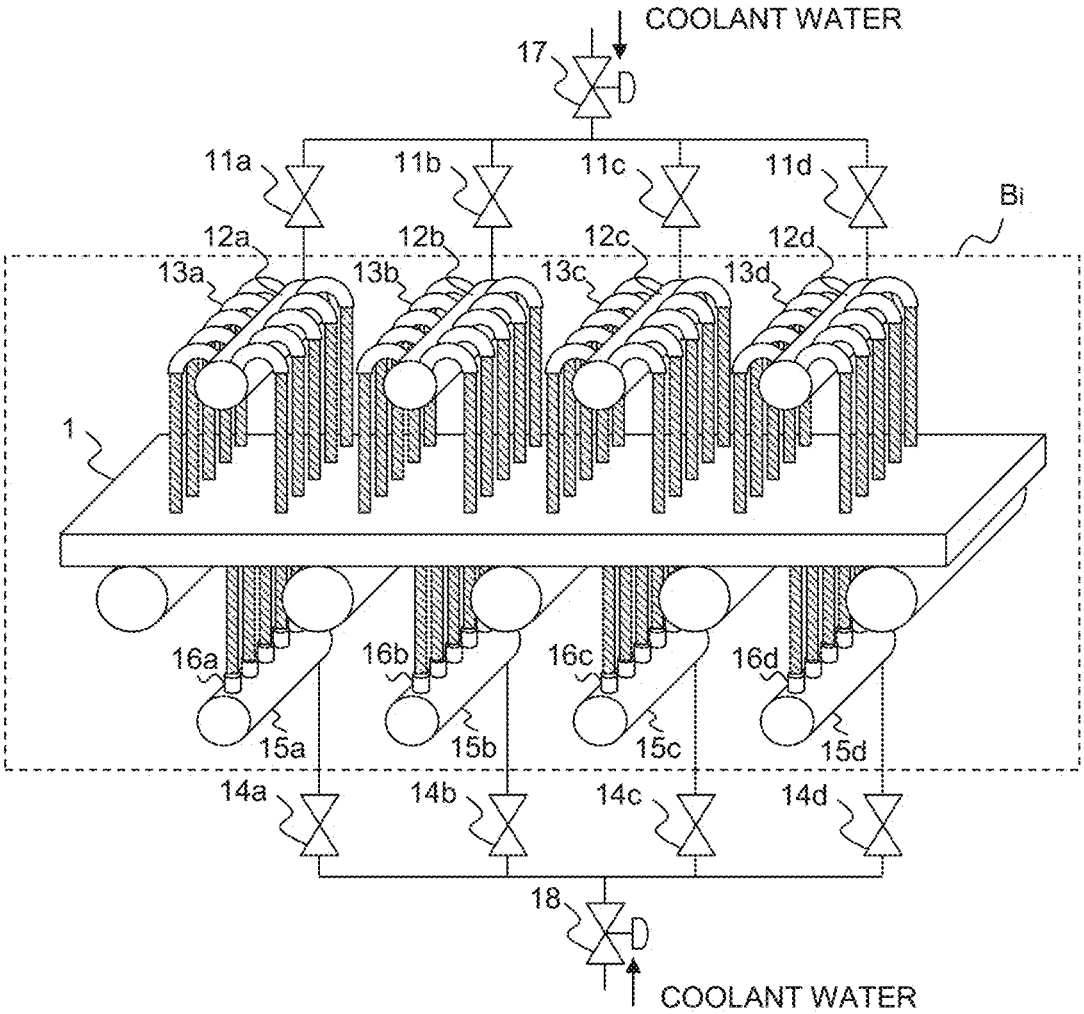
FIG. 13 is a diagram illustrating a configuration example of a cooling bank in a fifth embodiment.

FIG. 13 is a diagram for illustrating a configuration example of a cooling bank in a fifth embodiment. In the example shown in FIG. 13, a top surface flow control valve 17 is provided upstream of the top surface cooling valve 11. A bottom surface flow control valve 18 is also provided upstream of the bottom surface cooling valve 14.

In the first embodiment, the coolant injection amount from the cooling bank $B_i$ is adjusted by opening and closing the valves based on the numbers $N_{top}^{FB}$ and the $N_{bot}^{FB}$ of the open valves of the top surface cooling valve 11 and the bottom surface cooling valve 14. In the fifth embodiment, flow rates of the coolant water from the top surface flow control valve 17 and the bottom surface flow control valve 18 are adjusted.

The flow rate of the coolant water from the top surface flow control valve 17 (a top surface flow amount) and the flow rate of the coolant water from the bottom surface flow control valve 18 (a bottom surface flow amount) are calculated by, for example, counting the number of valves opened on the upper surface side and the number of valves opened on the lower surface side from the open and close states of the valves calculated in the first embodiment, and converting them into the top surface flow amount and the bottom surface flow amount based on the following Equation (22). The calculated top surface flow amount and bottom surface flow amount are output to the valve control part 28.

[Equation 22]

$$q^i = q^i_{max} \frac{N^i_{calc}}{N^i_{max}} \tag{22}$$

In Equation (22), q I is a total flow amount of the upper surface and the lower surface in the cooling bank $B_i$, and $q_{max}^i$ is a maximum flow amount of the upper surface and the lower surface in the cooling bank $B_i$. $N_{calc}^i$ s the number of valves opened on the upper surface side and the lower surface side calculated for the cooling bank $B_i$. $N_{max}^i$ is the maximum number of valves that can be opened on the upper surface side and the lower surface side in the cooling bank $B_i$.

The top surface flow amount and surface flow amount and the bottom surface flow amount is not limited thereto, and the top surface flow amount and the bottom surface flow amount may be directly obtained by applying the flow rate of each cooling bank to the temperature model. In this case, the multiple top surface cooling valves of the same cooling bank $B_i$ have the same valve priority, and the bottom surface cooling valve also has the same valve priority. However, the valve priority of the top surface cooling valve and that of the bottom surface cooling valve may be the same or different.

In the fifth embodiment, the valve control part 28 operates the top surface flow control valve 17 and the bottom surface flow control valve 18 based on the top surface flow amount $q_{top}^1$ to $q_{top}^N$ and the bottom surface flow amount $q_{bot}^1$ to $q_{bot}^N$ of each cooling banks $B_1$ to $B_N$ given from the setting calculation part 23, the FF control calculation part 24, and the FB control calculation part 25.

REFERENCE SIGNS LIST

1 Steel plate 2*a* Finisher delivery-side pyrometer, 2*a* Finisher delivery side top surface pyrometer, 2*b* Finish delivery side bottom surface pyrometer, 3 Coiler entry-side top surface pyrometer, 4 Coiler entry-side bottom surface pyrometer, 5 Finishing mill, 7 Coiler, 10 Cooling equipment, 11*a* to 11*h* Top surface cooling valve, 14*a* to 14*h* Bottom surface cooling valve, 20 Temperature control device, 20*a* Processor, 20*b* Memory, 40 Setup device, $B_1$ to $B_N$ Cooling bank, CP/CPtgt Piece

What is claimed is:

1. A device for controlling temperature of a steel plate cooled by coolant water from cooling bank group provided downstream of a rolling mill and wound by a coiler provided downstream of the cooling bank group, the device comprising:

a processor configured to execute various types of information processing, wherein the cooling bank group includes FF bank group indicating cooling bank group for feedforward control and FB bank group indicating cooling bank group for feedback control, wherein the processor is configured to:

acquire rolling setup information including at least valve pattern information related to opening order of multiple cooling valves of the cooling bank group and target value information of a coiling temperature of the steel plate, measured value information of rolling mill delivery-side temperature indicating a temperature of the steel plate at a delivery side of the rolling mill, measured value information of coiler entry-side top surface temperature indicating a temperature of a top surface of the steel plate at an entry side of the coiler, measured value information of coiler entry-side bottom surface temperature indicating a temperature of a bottom surface of the steel plate at the entry side of the coiler, and conveying speed information of the steel plate;

calculate respective positions of segments constituting the steel plate based on the conveying speed;

calculate a brief predicted value of coiling top surface temperature indicating the coiling temperature at the top surface of the steel plate and a brief predicted value of coiling bottom surface temperature indicating the coiling temperature at the bottom surface of the steel plate based on the rolling setup information and a preset temperature model;

calculate target values of first and second control indexes related to the coiling temperature based on the target value of the coiling temperature;

calculate initial water injection amounts in the FF bank group and the FB bank group such that the target value of the first control index matches the brief predicted value of the first control index that is calculated based on the brief predicted values of the coiling top surface temperature and the coiling bottom surface temperature;

correct the valve pattern such that the target value of the second control index matches the brief predicted value of the second control index that is calculated based on brief predicted values of the coiling top surface temperature and the coiling bottom surface temperature;

calculate a detailed prediction value of the coiling top surface temperature and a detailed prediction value of the coiling bottom surface temperature based on the measured value of the rolling mill delivery-side temperature, the conveying speed, the rolling setup information, the corrected valve pattern, and the temperature model;

calculate an FF water injection amount indicating a coolant injection amount in the FF bank group such that the target value of the first control index matches the detailed prediction value of the first control index that is calculated based on detailed prediction values of the coiling top surface temperature and the coiling bottom surface temperature;

calculate an FB water injection amount indicating a coolant injection amount in the FB bank group based on the measured values of the coiler entry-side top surface temperature and the coiler entry-side bottom surface temperature, the conveying speed, the rolling setup information, and the corrected valve pattern such that the target value of the first control index matches the measured value of the first control index that is calculated based on the measured values of the coiler entry-side top surface temperature and the coiler entry-side bottom surface temperature, and the target value of the second control index matches the measured value of the second control index that is calculated based on the measured values of the coiler entry-side top surface temperature and the coiler entry-side bottom surface temperature;

control a coolant injection amount in the FF bank group based on respective positions of the segments, the initial water injection amount, and the FF water injection amount; and control a coolant injection amount in the FB bank group based on respective positions of the segments, the initial water injection amount, and the FB water injection amount.

2. The device according to claim 1, wherein the processor is further configured to:

acquire information on at least one of a rolling speed in a final stand of the rolling mill and a coiling speed in the coiler; and calculate the conveying speed based on the at least one of the rolling speed and the coiling speed.

3. The device according to claim 1, wherein the processor is configured to acquire information on the conveying speed from a speedometer provided in the middle of the cooling bank group.

4. The device according to claim 1, wherein the information on the measured value of the rolling mill delivery-side temperature includes information on a measured value of a rolling mill delivery side top surface temperature indicating a temperature of the top surface of the steel plate at the delivery side of the rolling mill and information on a measured value of a rolling mill delivery side bottom surface temperature indicating a temperature of the bottom surface of the steel plate at the delivery side of the rolling mill.

5. The device according to claim 1, wherein, in the calculation of the FB water injection amount, the processor is configured to:

calculate a detailed prediction value of the coiling top surface temperature and the coiling bottom surface temperature for the segment reaching the entry side of the FB bank group whenever each of the segments reaches the entry side of the FB bank group;

correct a detailed prediction value of the coiling top surface temperature calculated for a subsequent segment based on a deviation between a detailed prediction value of the coiling top surface temperature calculated for a leading segment that has reached a position of a coiler entry side pyrometer that is disposed to face an entry side of the coiler and measures the coiler entry-side top surface temperature and the coiler entry-side bottom surface temperature and a detailed prediction value of the coiling top surface temperature calculated for the subsequent segment that has reached the entry side of the FB bank group when the leading segment has reached the position of the coiler entry side pyrometer; and correct the detailed prediction value of the coiling bottom surface temperature calculated for the subsequent segment based on a deviation between the detailed prediction value of the coiling bottom surface temperature calculated for the leading segment and the detailed prediction value calculated for the subsequent segment.

6. The device according to claim 1, wherein the processor is configured to:

calculate a predicted value for learning of the coiling top surface temperature and a predicted value for learning of the coiling bottom surface temperature based on historical information of the conveying speed, the rolling setup information, historical information of measured values of the coiler entry-side top surface temperature and the coiler entry-side bottom surface temperature, operation performance information of the multiple cooling valves, and the temperature model; and calculate a learned value of the temperature model based on an error between the measured value of the coiler entry-side top surface temperature and the predicted value for learning of the coiling top surface temperature and an error between the measured value of the coiler entry-side bottom surface temperature and the predicted value for learning of the coiling bottom surface temperature.

7. The device according to claim 1, wherein the processor is configured to control the coolant injection amount in the FF bank group and the FB bank group by switching open and close states of the multiple cooling valves.

8. The device according to claim 1, wherein the processor is configured to control the coolant injection amount in the FF bank group and the FB bank group by operating a flow control valve that adjusts the coolant injection amount from the multiple cooling valves.

9. A device for controlling temperature of a steel plate cooled by coolant water from first and second cooling bank groups provided downstream of a rolling mill and wound by a coiler provided downstream of the first and second cooling bank groups, the device comprising:

a processor configured to execute various types of information processing, wherein the first cooling bank group includes a first FF bank group indicating cooling bank group for feedforward control and a first FB bank group indicating cooling bank group for feedback control, wherein the second cooling bank group includes a second FF bank group indicating the cooling bank group for feedforward control and a second FB bank group indicating the cooling bank group for feedback control, wherein the first FB bank group is provided downstream of the first FF bank group, the second FF bank group is provided downstream of the first FB bank group, and the second FB bank group is provided downstream of the second FF bank group, wherein the processor is configured to:

acquire rolling setup information including at least information of valve patterns related to opening orders of multiple cooling valves included in the first and second cooling bank groups, information of target values of coiling temperatures of the steel plate, and information of target values of intermediate temperatures indicating temperatures of the steel plate at intermediate positions of the first FB bank group and the second FF bank group; information of measured values of rolling mill delivery-side temperature indicating a temperature of the steel plate at a delivery side of the rolling mill, information of measured values of coiler entry-side top surface temperature indicating a temperature of the top surface of the steel plate at an entry side of the coiler; information of measured values of coiler entry-side bottom surface temperature indicating a temperature of a bottom surface of the steel plate at the entry side of the coiler: information of measured values of middle top surface temperature indicating a temperature of the top surface of the steel plate at the intermediate position, information of measured values of middle bottom surface temperature indicating a temperature of the bottom surface of the steel plate at the intermediate position, and information of conveying speed of the steel plate;

calculate respective positions of segments constituting the steel plate based on the conveying speed;

calculate a brief predicted value of a middle top surface temperature indicating the intermediate temperature at the top surface of the steel plate and a brief predicted value of a middle bottom surface temperature indicating the intermediate temperature at the bottom surface of the steel plate based on the rolling setup information and a preset first temperature model;

calculate intermediate target values indicating target values of first and second control indexes related to the intermediate temperature, based on the target value of the intermediate temperature;

calculate a first initial water injection amount in the first cooling bank group such that the middle target value of the first control index is equal to the brief predicted value of the first control index that is calculated based on the brief predicted values of the middle top surface temperature and the middle bottom surface temperature;

correct the valve pattern for the first cooling bank group such that the intermediate target value of the second control index matches the brief predicted value of the second control index that is calculated based on the brief predicted values of the middle top surface temperature and the middle bottom surface temperature;

calculate a detailed prediction value of the middle top surface temperature and a detailed prediction value of the middle bottom surface temperature based on the measured value of the rolling mill delivery-side temperature, the conveying speed, the rolling setup information, the corrected valve pattern for the first cooling bank group, and the first temperature model;

calculate a first FF water injection amount indicating a coolant injection amount in the first FF bank group such that the intermediate target value of the first control index matches the detailed prediction value of the first control index that is calculated based on the detailed prediction values of the middle top surface temperature and the middle bottom surface temperature, and such that the intermediate target value of the second control index matches the detailed prediction value of the second control index related to the intermediate temperature that is calculated based on the detailed prediction values of the middle top surface temperature and the middle bottom surface temperature;

calculate a first FB water injection amount indicating a coolant injection amount in the first FB bank group based on the measured values of the middle top surface temperature and the middle bottom surface temperature, the conveying speed, the rolling setup information, and the corrected valve pattern for the first cooling bank group such that the middle target value of the first control index matches the middle measured value of the first control index that is calculated based on the measured values of the middle top surface temperature and the middle bottom surface temperature, and such that the middle target value of the second control index matches the middle measured value of the second control index that is calculated based on the measured values of the middle top surface temperature and the middle bottom surface temperature;

calculate a brief predicted value of coiling top surface temperature indicating the coiling temperature at the top surface of the steel plate and a brief predicted value of coiling bottom surface temperature indicating the coiling temperature at the bottom surface of the steel plate based on the rolling setup information and a preset second temperature model;

calculate final target values indicating target values of first and second control indexes related to the coiling temperature based on the target value of the coiling temperature;

calculate a second initial water injection amount in the second cooling bank group such that the final target value of the first control index is equal to the brief predicted value of the first control index that is calculated based on the brief predicted values of the coiling top surface temperature and the coiling bottom surface temperature;

correct the valve pattern for the second cooling bank group such that the final target value of the second control index matches the brief predicted value of the second control index that is calculated based on the brief predicted values of the coiling top surface temperature and the coiling bottom surface temperature;

calculate a detailed prediction value of the coiling top surface temperature and a detailed prediction value of the coiling bottom surface temperature based on the measured values of the middle top surface temperature and the middle bottom surface temperature, the conveying speed, the rolling setup information, the corrected valve pattern for the second cooling bank group, and the second temperature model;

calculate a second FF water injection amount indicating a coolant injection amount in the second FF bank group such that the final target value of the first control index matches the detailed prediction value of the first control index that is calculated based on the detailed prediction values of the coiling top surface temperature and the coiling bottom surface temperature and such that the final target value of the second control index matches the detailed prediction value of the second control index related to the coiling temperature that is calculated based on the detailed prediction values of the coiling top surface temperature and the coiling bottom surface temperature;

calculate a second FB water injection amount indicating a coolant injection amount in the second FB bank group based on the measured values of the coiling top surface temperature and the coiling bottom surface temperature, the conveying speed, the rolling setup information, and the corrected valve pattern for the second cooling bank group, such that the final target value of the first control index matches the final measured value of the first control index that is calculated based on the measured values of the coiler entry-side top surface temperature and the coiler entry-side bottom surface temperature, and the final target value of the second control index matches the final measured value of the second control index that is calculated based on the measured values of the coiler entry-side top surface temperature and the coiler entry-side bottom surface temperature;

control a coolant injection amount in the first FF bank group based on respective positions of the segments, the first initial water injection amount and the first FF water injection amount;

control a coolant injection amount in the first FB bank group based on respective positions of the segments, the first initial water injection amount, and the first FB water injection amount;

control a coolant injection amount in the second FF bank group based on respective positions of the segments, the second initial water injection amount, and the second FF water injection amount; and control the coolant injection amount in the second FB bank group based on respective positions of the segments, the second initial water injection amount and the second FB water injection amount.

10. The device according to claim 9, wherein the processor is configured to:

calculate a predicted value for learning of the middle top surface temperature and a predicted value for learning of the middle bottom surface temperature based on historical information of the conveying speed, the rolling setup information, historical information of measured values of the middle top surface temperature and the middle bottom surface temperature, operation performance information of the multiple cooling valves, and the first temperature model;

calculate a learned value of the first temperature model based on an error between the measured value of the middle top surface temperature and the predicted value for learning of the middle top surface temperature and an error between the measured value of the middle bottom surface temperature and the predicted value for learning of the middle bottom surface temperature;

calculate a predicted value for learning of the coiling top surface temperature and a predicted value for learning of the coiling bottom surface temperature based on the conveying speed information, the rolling setup information, the measured value information of the coiler entry-side top surface temperature and the coiler entry-side bottom surface temperature, the operation performance information of the multiple cooling valves, and the second temperature model; and calculate a learned value of the second temperature model based on an error between the measured value of the coiling top surface temperature and the predicted value for learning of the coiling top surface temperature and an error between the measured value of the coiling bottom surface temperature and the predicted value for learning of the coiling bottom surface temperature.

* * * * *